US006273540B1

(12) United States Patent
Takamura et al.

(10) Patent No.: US 6,273,540 B1
(45) Date of Patent: Aug. 14, 2001

(54) DRIVING DEVICE OF PRINTER HEAD

(75) Inventors: Jun Takamura, Mishima; Noboru Nitta; Shunichi Ono, both of Shizuoka-ken, all of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/228,891

(22) Filed: Jan. 11, 1999

(30) Foreign Application Priority Data

Jan. 16, 1998 (JP) ..... 10-006627
Apr. 21, 1998 (JP) ..... 10-110590

(51) Int. Cl.[7] ..... B41J 2/205
(52) U.S. Cl. ..... 347/15; 358/1.9
(58) Field of Search ..... 347/15, 43; 358/1.9

(56) References Cited

U.S. PATENT DOCUMENTS 5,149,212 9/1992 Murakami ..... 400/124.02
5,894,242 4/1999 Fujimoto ..... 327/407
6,046,822 * 4/2000 Wen et al. ..... 358/1.9
6,102,513 * 8/2000 Wen et al. ..... 347/15

FOREIGN PATENT DOCUMENTS 0 367 550 5/1990 (EP) .
0 655 340 5/1995 (EP) .
0 779 151 A 6/1997 (EP) .
6-015846 A 1/1994 (JP) .
8-216457 A 8/1996 (JP) .
9-011457 A 1/1997 (JP) .
09-109389 4/1997 (JP) .

OTHER PUBLICATIONS

Patent Abstracts of Japan, vol. 017, No. 041 (M–1359), Jan. 26, 1993 and JP 04–259572 (Nec Corp.), Sep. 16, 1992—Abstract.

* cited by examiner

*Primary Examiner*—Thinh Nguyen
(74) *Attorney, Agent, or Firm*—Frishauf, Holtz, Goodman, Langer & Chick, P.C.

(57) ABSTRACT

A driving device of a printer head which receives serial print data of the maximum four bits tone, and selects a conductive waveform of a head by this print data for printing, comprising a serial parallel conversion circuit which converts serial print data of two bits tone for example into parallel data and which can convert maximum four bits in parallel, four bit parallel shift register for transferring the parallel print data converted by this conversion circuit two bits by two bits, and a mask circuit for masking the four bits parallel data transferred from this shift register other than a necessary two bits, and a conductive waveform of a head is selected by the two bits print data from this mask circuit to print.

17 Claims, 22 Drawing Sheets

DRIVING DEVICE OF PRINTER HEAD

BACKGROUND OF THE INVENTION

The present invention relates to a driving device of a printer head which receives serial print data of maximum n bits tone, and selects a conductive waveform depending upon the received print data for printing.

For example, in Jpn. Pat. Appln. KOKAI Publication No. 8-216457, as shown in FIG. 23, print data with respect to each nozzle of print head 2 from a CPU 1 is converted through a tone serial data converting section 3 into serial print data including tone information, and the converted data is supplied to a tone parallel data converting section 4. The tone parallel data converting section 4 converts the serial print data into tone parallel data corresponding to the number of tones of nozzle, and the converted tone parallel data is supplied to a driver 6 through a duty control section 5, and a print head 2 is driven by this driver 6.

In Jpn. Pat. Appln. KOKAI Publication No. 9-11457, as shown in FIG. 24, there are provided common waveform generating means 7 for generating a plurality of driving voltage waveforms corresponding to sizes of dots, and system control means 8 for generating print data, shift clock and the like. Two-bits tone data which is print data is supplied from the system control means 8 to a shift circuit 9 and is stored therein, and the tone data stored in the shift circuit 9 is latched by a latch circuit 10 at a predetermined timing, the latched output is converted by a decoder 11 and then, a multiplexer 13 is driven through signal processing means 12 to select one driving voltage waveform from the common waveform generating means 7 to drive a piezoelectric element.

In Jpn. Pat. Appln. KOKAI Publication No. 6-15846, as shown in FIG. 25, two bits parallel data S11 and S12 are supplied to shift registers 14 and 15, respectively, data in each bit is latched by a latch circuit 16 from the shift registers, and the latched output is supplied to a parallel/serial conversion circuit 17. On the other hand, an output of an interval timer 19 of a print command pulse processing section 18 is supplied to the parallel/serial conversion circuit 17, and is supplied to a flip-flop 21 through an AND gate 20. An output of this flip-flop and an output of an output protection circuit which monitors a power supply voltage are supplied to an AND gate 23, an output of this AND gate 23 and an output of the parallel/serial conversion circuit 17 are supplied to an AND gate 24, and an output of this AND gate 24 drives a transistor Tr to turn on the electricity for an exothermic resistor R.

In the case of Jpn. Pat. Appln. KOKAI Publication No. 8-216457, when data having two values is handled for example, since it is necessary to add dummy data such that the amount of bits becomes the same as the number of tones, and to transfer the same, there is a problem that it takes a time for transferring the data. In the case of Jpn. Pat. Appln. KOKAI Publication No. 9-11457, when data having two values is handled for example, since it is also necessary to add dummy data such that the amount of bits becomes the same as the number of shifts of the shift circuit, and to transfer the same, there is a problem that it takes a time for transferring the data. Further, in the case of Jpn. Pat. Appln. KOKAI Publication No. 6-15846, there are provided shift registers in two parallel steps, data is transferred as two bits parallel data and therefore, there is a problem that the number of signal lines is increased.

BRIEF SUMMARY OF THE INVENTION

It is an object of the present invention to provide a driving device of printer head in which data can be transferred in series and thus, one signal line suffices for transferring data, and even when data of two values is handled, it is unnecessary to add and transfer dummy data, and data transferring time can be shortened more as the amount of bits of print data is smaller so that data can be printed more swiftly.

The present invention described in claim 1 is that a driving device of a printer head which receives one bit serial print data of maximum n bits tone per one pixel and which determines a driving waveform for driving a printer head in accordance with the received print data, comprising:

serial input shift register means for shifting the received one bit serial print data; and changing means for changing a shift path of the shift register means in accordance with the number m ($1 \leqq m \leqq n$) of bits of tone to be received.

According to the invention described in claim 1, data can be transferred in series and thus, one signal line suffices for transferring data, and even when data of two values is handled, it is unnecessary to add and transfer dummy data, and data transferring time can be shortened more as the amount of bits of print data is smaller so that data can be printed more swiftly.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A first embodiment of the present invention will be explained with reference to FIGS. 1 to 4.

Figure 1:
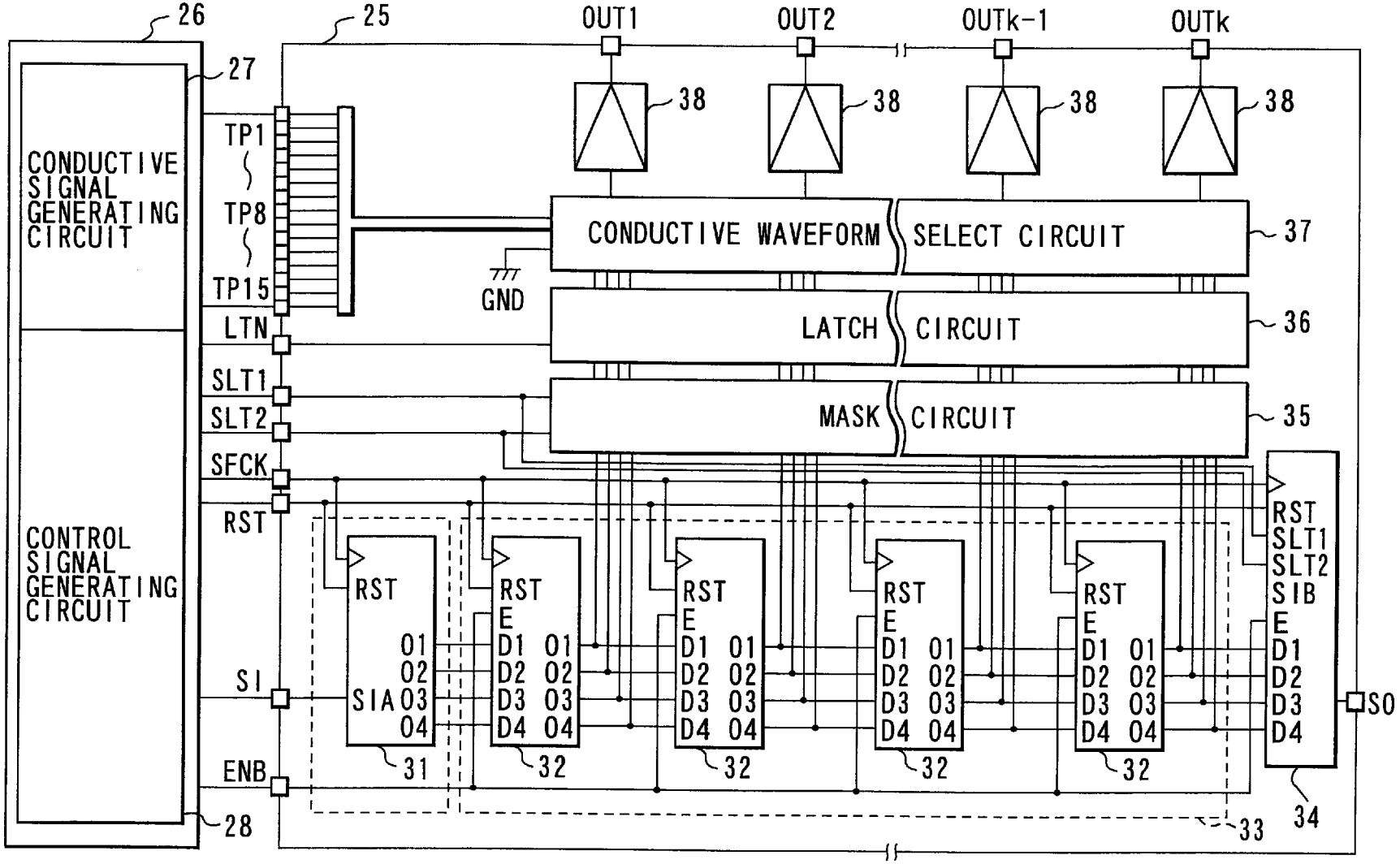
FIG. 1 is a circuit block diagram showing a first embodiment of the present invention.

As shown in FIG. 1, there are provided: a serial/parallel conversion circuit 31 which converts serial print data SI of m bits ($1 \leqq m \leqq 4$) tone into parallel data by m bits each and which can convert the maximum n=4 bits of data into parallel data; a parallel shift register 33 having k rows of four-bit parallel shift registers 32 which transfer parallel print data of m bits from the serial/parallel conversion circuit 31 by m bits each; and a serial data output circuit 34 which converts the parallel print data of m bits transferred from a four-bit parallel shift register 32 of the last raw of the parallel shift register 33 into serial data to output as serial print data SO.

That is, data output terminals O1 to O4 of the serial parallel conversion circuit 31 are connected to data input terminals D1 to D4 of the four-bit parallel shift register 32 of the first step, data output terminals O1 to O4 of the four-bit parallel shift register 32 of the first to k−1 th step are connected to data input terminals D1 to D4 of the four-bit parallel shift register 32 of the second to k th steps, respectively, and data output terminals O1 to O4 of the four-bit parallel shift register 32 of k th step which is the last step are connected to data input terminals D1 to D4 of the serial data output circuit 34. Reset signal RST, shift clock SFCK are supplied to each of the serial/parallel conversion circuit 31, each of the four-bit parallel shaft registers 32 and the serial data output circuit 34.

The data output terminals O1 to O4 of each of the four-bit parallel shift registers 32 are connected to input terminals of a mask circuit 35. The mask circuit 35 takes in parallel data of k th step transferred from each of the four-bit parallel shift registers 32, and masks them except m bit which is required in each of steps by effective bit select signals SLT1 and SLT2. The parallel data of k steps from the mask circuit 35 is supplied to the latch circuit 36. The effective bit select signals SLT1 and SLT2 are also supplied to the serial data output circuit 34.

The serial data output circuit 34 supplies serial print data to a printer head driving device of the next step when a large number of printer head driving devices are connected to one another in a cascade manner. Normally, in the case of a line printer which prints one line by one line, a plurality of printer head driving devices are connected to one another in a cascade manner.

The latch circuit 36 latches the parallel data of k th step from the mask circuit 35 at the input timing of latch signal LTN. The parallel data of k th steps latched by the latch circuit 36 is supplied to a conductive waveform select circuit 37. The conductive waveform select circuit 37 selects one of conductive signals TP1 to TP15 and GND (ground level) from a conductive signal generating circuit 27 for each of the steps based on the parallel data of k th step from the latch circuit 36, and supplies the selected signal to head drivers 38. The head drivers 38 output head driving signal OUT1 to OUTk, respectively.

Here, the reference number 25 represent a driving device, and the reference number 26 represents a control section. The control section 26 comprises a conductive signal generating circuit 27 for outputting conductive signals TP1 to TP15, and a control signal generating circuit 28 for outputting latch signal LTN, effective bit select signal SLT1, SLT2, shift clock SFCK, a reset signal RST, serial print data SI and enable signal ENB.

Figure 2:
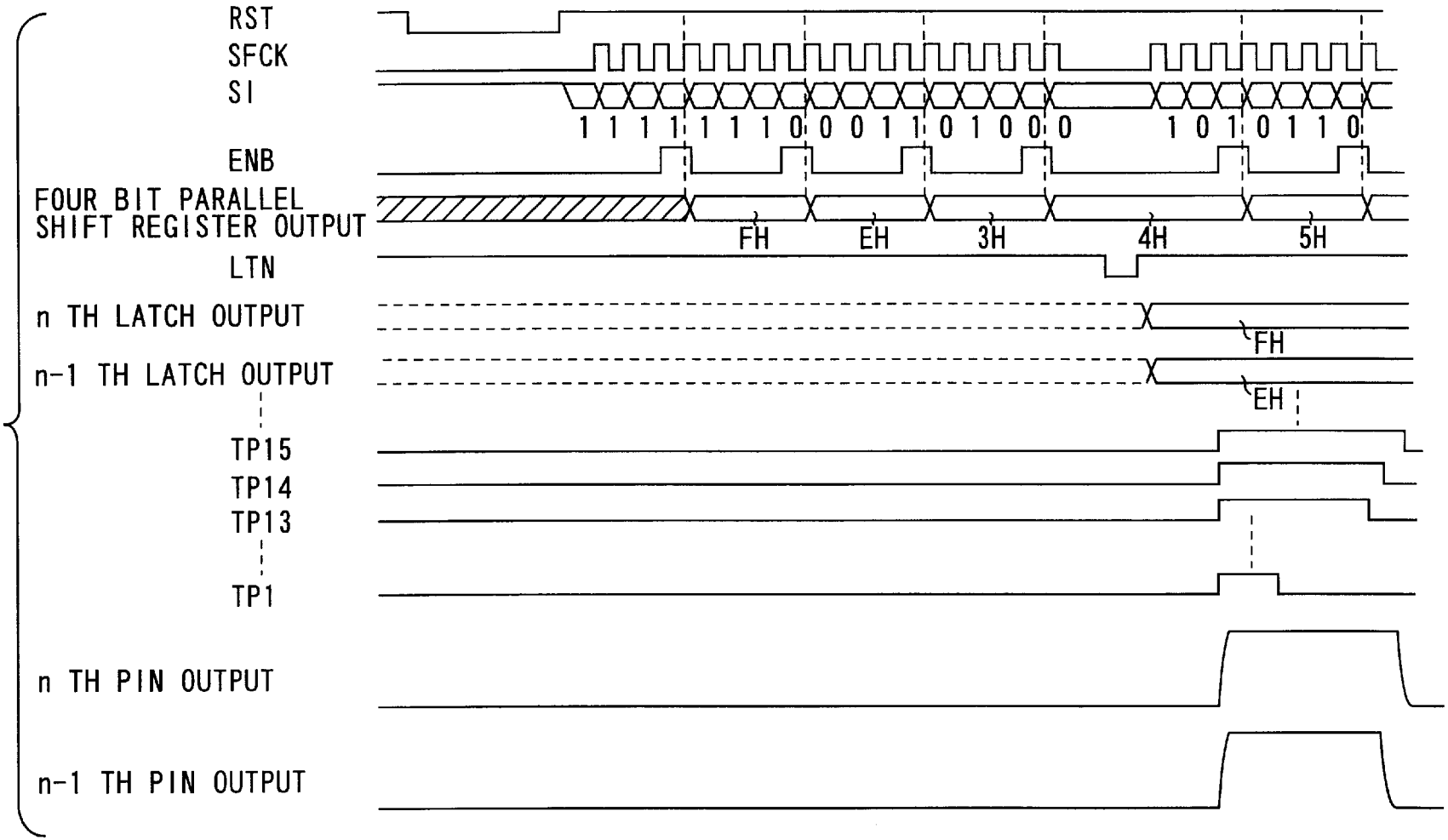
FIG. 2 is a timing waveform diagram showing operation timing when print data in which each pixel comprises four bits is handled in the first embodiment.

In such a structure, if one pixel comprises four bits for example, four bits serial print data SI is input, and the operation timing of each the part is as shown in FIG. 2. That is, if the reset signal RST rises from low level to high level, the serial/parallel conversion circuit 31, each of the four-bit parallel shift registers 32 and the serial data output circuit 34 are initialized, and in this state, the serial print data SI and the shift clock SFCK are input to the serial/parallel conversion circuit 31, and the serial/parallel conversion circuit 31 converts the four-bit parallel print data whenever the four-bit print data is input. To each of the four-bit parallel shift registers 32 and the serial data output circuit 34, the shift clock SFCK is input, and the enable signal ENB is also input in synchronous with fourth bit of the serial print data.

In this manner, each of the four-bit parallel shift registers 32 transfers the four-bit parallel print data to the four-bit parallel shift register 32 at the next step at the input timing of the enable signal ENB. And if the shift of the four bits parallel print data with respect to the four-bit parallel shift register 32 of the k th step is completed, the parallel data from the four-bit parallel shift register 32 of the last step is converted into the serial print data by the serial data output circuit 34, and are supplied to the printer head driving device of the next step.

If the shift of data with respect to the four-bit parallel shift registers of all of the printer head driving devices which are connected in the cascade manner is completed, and print data of an amount of one line has been shifted, the latch signal LTN is input, the print data of the amount of one line is subjected to a predetermined masking by the mask circuit 35 one pixel by one pixel and latched by the latch circuit 36. Since print data having the maximum tones of one-pixel four-bits is handled this time, the masking by the mask circuit 35 is not carried out.

The print data of the amount of one line latched by the latch circuit 36 is supplied to the conductive waveform select circuit 37 as four bits pixel data. The conductive waveform select circuit 37 selects one of conductive signals TP1 to TP15 and the GND, and the selected conductive signal is supplied to the corresponding head driver 38. The corresponding relationship between the four bits data and the conductive signals at that time is as shown in Table 1. The head driving signal selected for each of pixel in one line is output in this manner.

TABLE 1

| Print Data SI (Hex) | Conductive signal TPn |
|---|---|
| F | TP15 |
| E | TP14 |
| D | TP13 |
| C | TP12 |
| B | TP11 |
| A | TP10 |
| 9 | TP9 |
| 8 | TP8 |
| 7 | TP7 |
| 6 | TP6 |
| 5 | TP5 |
| 4 | TP4 |
| 3 | TP3 |
| 2 | TP2 |
| 1 | TP1 |
| 0 | GND |

As shown in FIG. 2, for example, if a latch output with respect to n th pixel is "FH", and a latch output with respect to n−1 th pixel is "EH", the conductive waveform select circuit 37 selects the conductive signal TP15 with respect to n th pixel, and selects the conductive signal TP14 with respect to n−1 th pixel. In this manner, n th pin output waveform for driving n th head element and n−1 th pin output waveform for driving n−1 th head element are generated.

Figure 3:
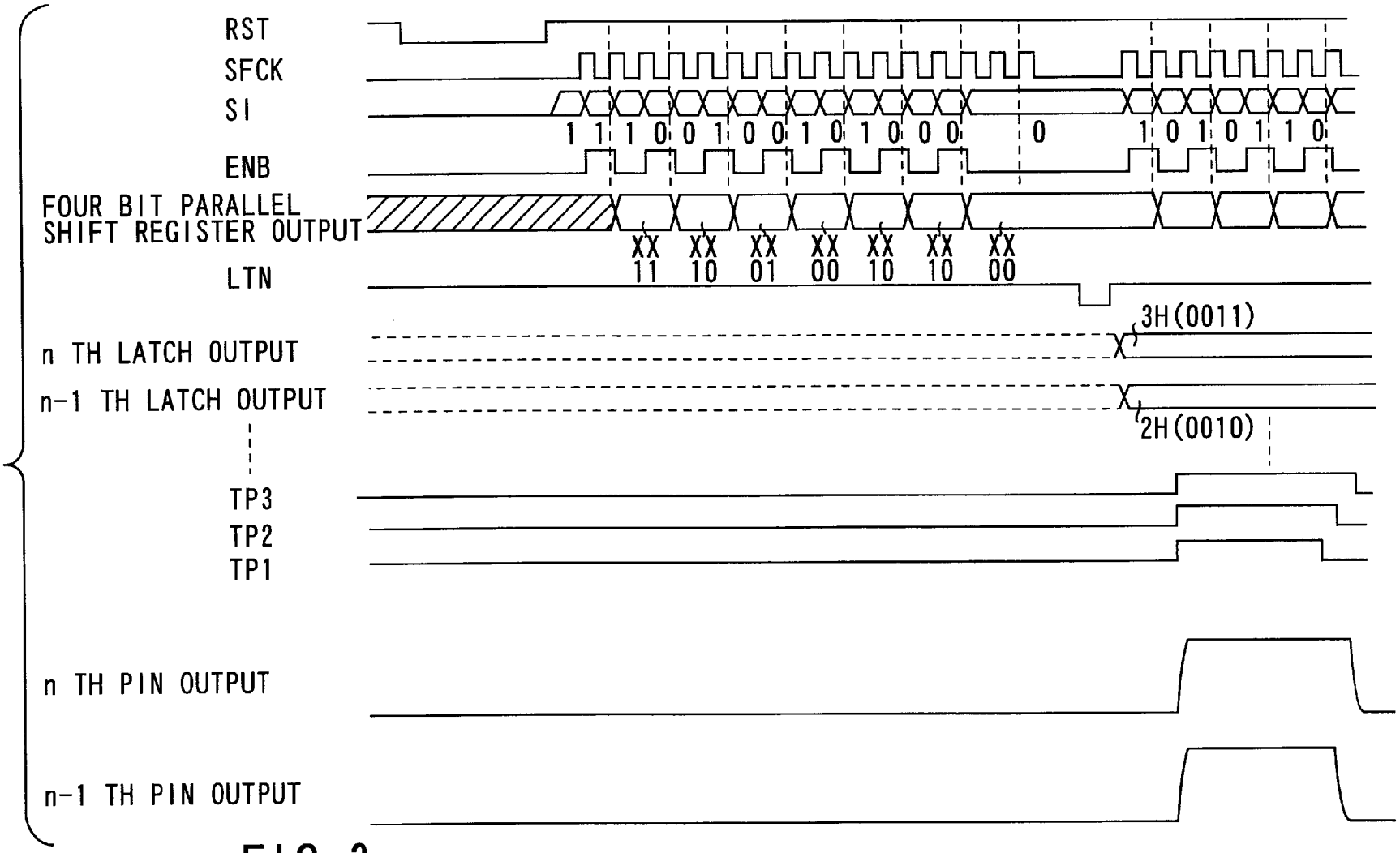
FIG. 3 is a timing waveform diagram showing operation timing when print data in which each pixel comprises two bits is handled in the first embodiment.

When one pixel comprises two bits, two bits serial print data SI is input, and the operation timing of each of the parts is as shown in FIG. 3. That is, if the reset signal rises from low level to high level, the serial/parallel conversion circuit 31, each of the four-bit parallel shift registers 32 and the serial data output circuit 34 are initialized and in this state, the serial print data SI and the shift clock SFCK are input to the serial/parallel conversion circuit 31, and whenever the two bits serial print data is input, the serial/parallel conversion circuit 31 converts the same into two bits parallel print data. At this time, the higher-order two bits (03, 04) of the serial/parallel conversion circuit 31 are the two bits print data input immediately before. The shift clock SFCK is input to each of the four-bit parallel shift registers 32 and the serial data output circuit 34, and the enable signal ENB is input in synchronously with the second bit of the serial print data.

In this manner, each of the four-bit parallel shift registers 32 transfers the two bits parallel print data to the four-bit parallel shift register 32 at a timing where enable signal ENB is input, thereby shifting data. If the shift of the two bits parallel print data with respect to the four-bit parallel shift register 32 of k th step is completed, parallel data from the four-bit parallel shift register 32 of the last step is converted by the serial data output circuit 34 into serial print data and supplied to the printer head driving device of the next step.

If the print data of amount of one line has been shifted, the latch signal LTN is input, and the print data of amount of one line is subjected to a predetermined masking by the mask circuit 35 pixel by pixel and latched by the latch circuit 36. That is, the mask circuit 35 masks the upper two bits among the four bits line to forcibly bring the data to "00", and outputs only the lower two bits to the latch circuit 36 as effective bits.

The print data of amount of one line latched by the latch circuit 36 is supplied to the conductive waveform select circuit 37 as two bits pixel data. The conductive waveform select circuit 37 selects one of the conductive signals TP1 to TP3 and the GND based on the two bits data for each pixel and supplies the selected conductive signal to the corresponding head driver 38.

That is, since the number of kinds of conductive signals (including GND) which can be selected when one pixel comprises two bits is four, the conductive signals TP4 to TP15 are not selected at that time, and only four kinds of signals, i.e., the conductive signals TP1 to TP3 and the GND are selected with respect to the two bits data. The conductive signals TP1 to TP3 at that time are different from the conductive signals TP1 to TP3 when one pixel comprises four bits, for example, the conductive signal TP3 corresponds to the conductive signal TP15 when it comprises four bits, the conductive signal TP2 corresponds to the conductive signal TP8 when it comprises four bits, and the conductive signal TP1 corresponds to the conductive signal TP1 when it comprises four bits.

The driving signal selected for each pixel of one line is output in this manner.

For example, as shown in FIG. 3, if the latch output with respect to n th pixel is "3H", and the latch output with respect to n−1 th pixel is "2H", the conductive waveform select circuit 37 selects the conductive signal TP3 with respect to n th pixel, and selects the conductive signal TP2 with respect to n−1 th pixel. In this manner, n th pin output waveform for driving n th head element and n−1 th pin output waveform for driving n−1 th head element are generated.

Figure 4:
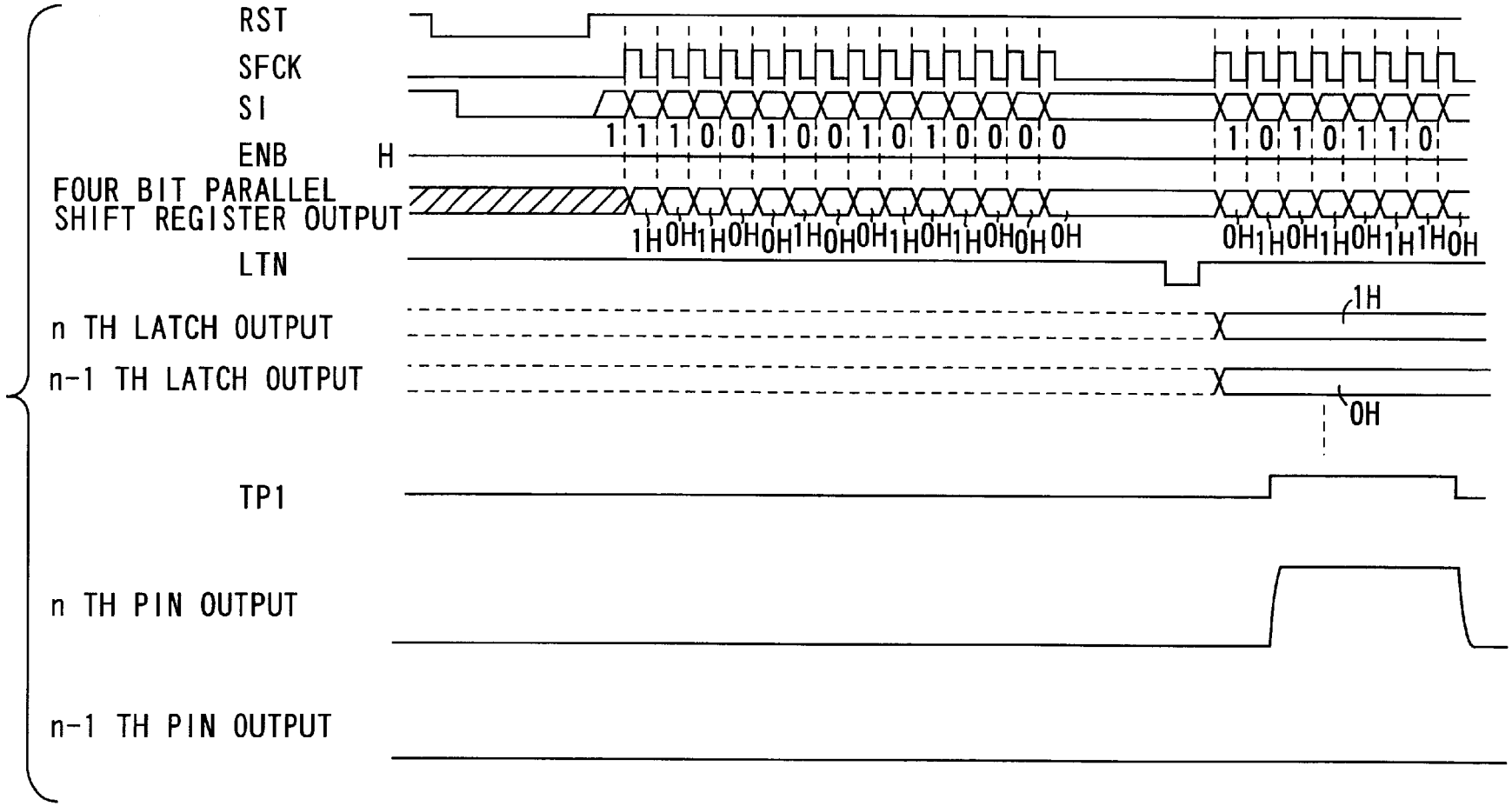
FIG. 4 is a timing waveform diagram showing operation timing when print data in which each pixel comprises one bit is handled in the first embodiment.

When one pixel comprises one bit, one bit serial print data SI is input, and the operation timing of each of parts is as shown in FIG. 4. That is, if the reset signal RST rises from low level to high level, the serial/parallel conversion circuit 31, each of the four-bit parallel shift registers 32 and the serial data output circuit 34 are initialized, and in this state, the serial print data SI and the shift clock SFCK are input to the serial/parallel conversion circuit 31, and the serial/parallel conversion circuit 31 allows the one bit serial print data to pass as it is. To each of the four-bit parallel shift registers 32 and the serial data output circuit 34, the shift clock SFCK is input, and the enable signal ENB which is always in high level state is also input.

In this manner, each of the four-bit parallel shift registers 32 sequentially transfers one bit print data to the four-bit parallel shift register 32 of the next step at a timing of the shift clock SFCK to shift data. If the shift of print data to the four-bit parallel shift register 32 of the k th step is completed, print data from the four-bit parallel shift register 32 of the last step passes through the serial data output circuit 34 as it is, and it is supplied to the printer head device of the next step.

If the shift of the print data of amount of one line is completed, the latch signal LTN is input, and the print data of amount of one line is subjected to a predetermined masking by the mask circuit 35 pixel by pixel and latched by the latch circuit 36. That is, the mask circuit 35 masks the upper three bits among the four bits line to forcibly bring the data to "000", and outputs only the lower one bit to the latch circuit 36 as an effective bit.

The print data of amount of one line latched by the latch circuit 36 is supplied to the conductive waveform select circuit 37 as one bit pixel data. The conductive waveform select circuit 37 selects one of the conductive signal TP1 and the GND based on the one bit data for each pixel and supplies the selected conductive signal to the corresponding head driver 38.

That is, since the number of kinds of conductive signals (including GND) which can be selected when one pixel comprises one bit is two, the conductive signals TP2 to TP15 are not selected at that time, and only two kinds of signals, i.e., the conductive signals TP1 and the GND are selected.

The driving signal selected for each pixel of one line is output in this manner, and two values can be printed.

For example, as shown in FIG. 4, if the latch output with respect to n th pixel is "1H", and the latch output with respect to n−1 th pixel is "0H", the conductive waveform select circuit 37 selects the conductive signal TP1 with respect to n th pixel, and selects the GND with respect to n−1 th pixel. In this manner, n th pin output waveform for driving n th head element and n−1 th pin output waveform for driving n−1 th head element are generated. The n th pin output waveform is the waveform of the signal TP1, and the n−1 th pin output waveform is a zero output waveform.

Since data can be transferred in series to the printer head driving device, the number of signal lines used for data transfer can be only one. Further, when serial print data at the maximum four bits tone can be received, even if the situation is changed such that two bits tone serial print data or one bit serial print data of two values is handed, it is unnecessary to add and transfer dummy data. Therefore, as the print data has smaller bit, the data transfer time can be shortened, and data can be printed faster.

Figure 5:
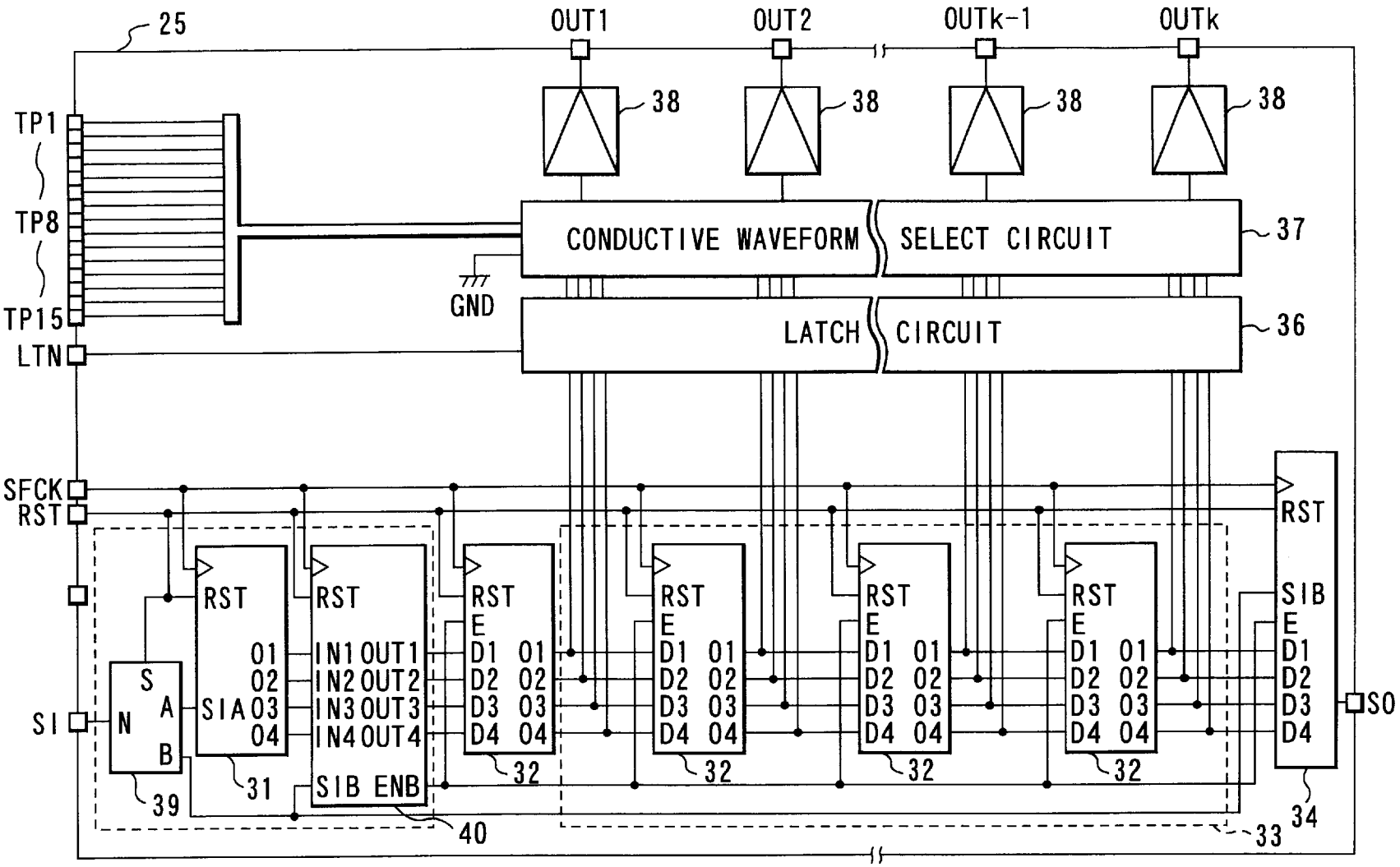
FIG. 5 is a circuit block diagram showing a second embodiment of the invention.

Next, a second embodiment of the present invention will be explained with reference to FIGS. 5 to 10. In FIG. 5, the control section 26 shown in FIG. 1 is omitted.

Elements similar to those in the above described first embodiment are designated by the same reference numerals, and portions different from the first embodiment will be described. In the second embodiment, as shown in FIG. 5, serial print data SI of m bits ($1 \leqq m \leqq 4$) tone is supplied to a select circuit 39.

The select circuit 39 supplies, mask data which is to be input instead of the serial print data SI when the reset signal RST is at low level, to a mask circuit 40 and the serial data output circuit 34 from an output terminal B, and the mask circuit 40 sets this mask data and masks data other than the required m bit data. The mask data to be supplied to the serial data output circuit 34 is output to a printer head driving device of a next step which is connected in the cascade manner, and is also set by the mask circuit in this printer head driving device of the next step.

The select circuit 39 supplies the serial print data SI which is input when the reset signal RST is at high level to the serial/parallel conversion circuit 31 from an output terminal A. The serial/parallel conversion circuit 31 converts this serial print data into parallel print data and then, supplies the same to input terminals lN1 to lN4 of the mask circuit 40. The mask circuit 40 masks the parallel print data input from the input terminals lN1 to lN4 other than required m bit data, and supplies the same from output terminals OUT 1 to OUT 4 to the four-bit parallel shift registers 32 of the first step.

Figure 6:
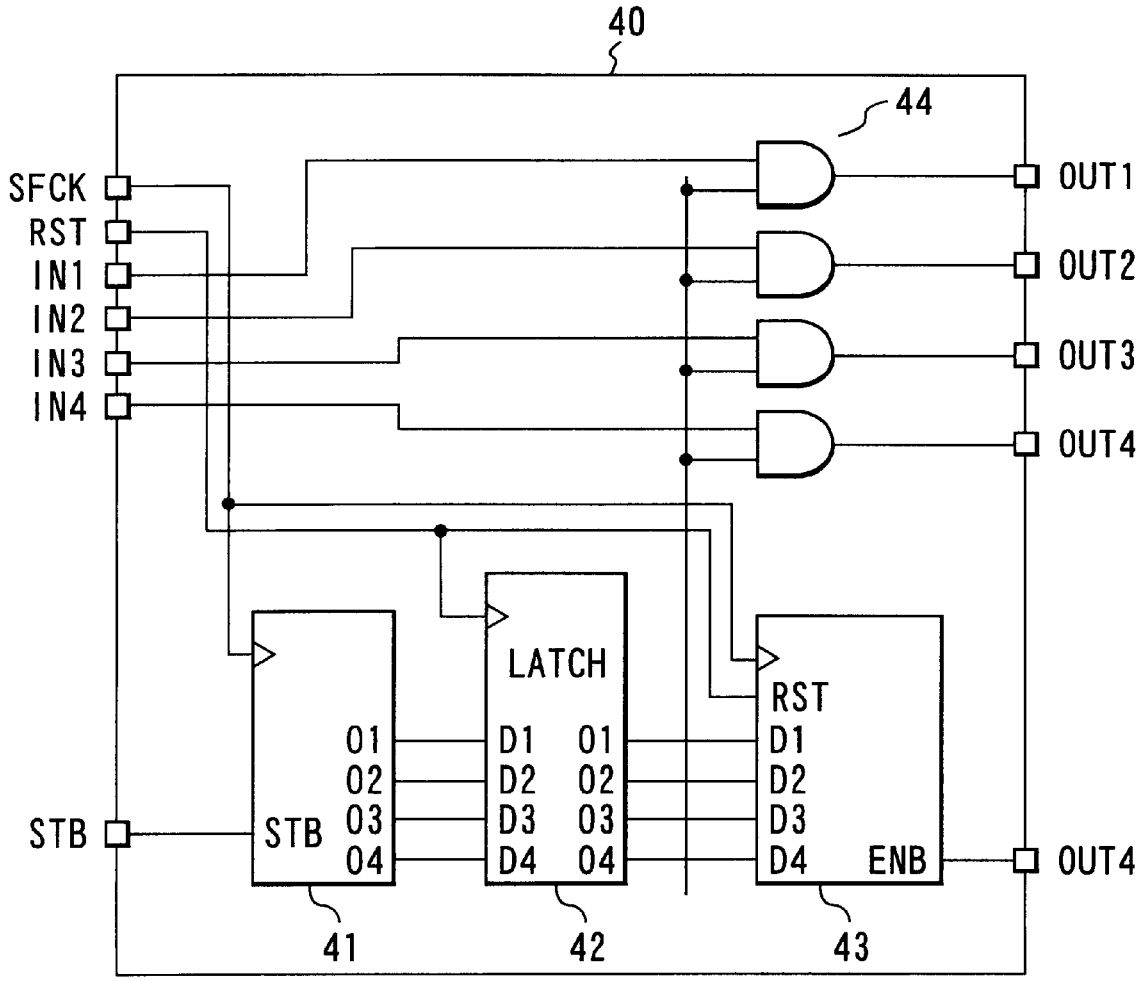
FIG. 6 is a block diagram showing a structure of a mask circuit in the second embodiment.

As shown in FIG. 6, the mask circuit 40 comprises a serial/parallel conversion circuit 41, a latch circuit 42, an enable signal generation circuit 43 and an AND gate circuit 44. After the mask circuit 40 inputs mask data from the select circuit 39 to the serial/parallel conversion circuit 41 to convert the same into parallel data, the latch circuit 42 latches the parallel data, and the latched output is supplied to the enable signal generation circuit 43 and the AND gate 44.

The enable signal generation circuit 43 determines a generation timing of the enable signal ENB based on the supplied data, and supplies the generated enable signal ENB to each of the four-bit parallel shift registers 32 and the serial data output circuit 34. The AND gate circuit 44 masks the parallel print data supplied from the input terminals lN1 to lN4 based on the mask data latched by the latch circuit 42, and output only the effective bit to the output terminals OUT1 to OUT 4.

Figure 7:
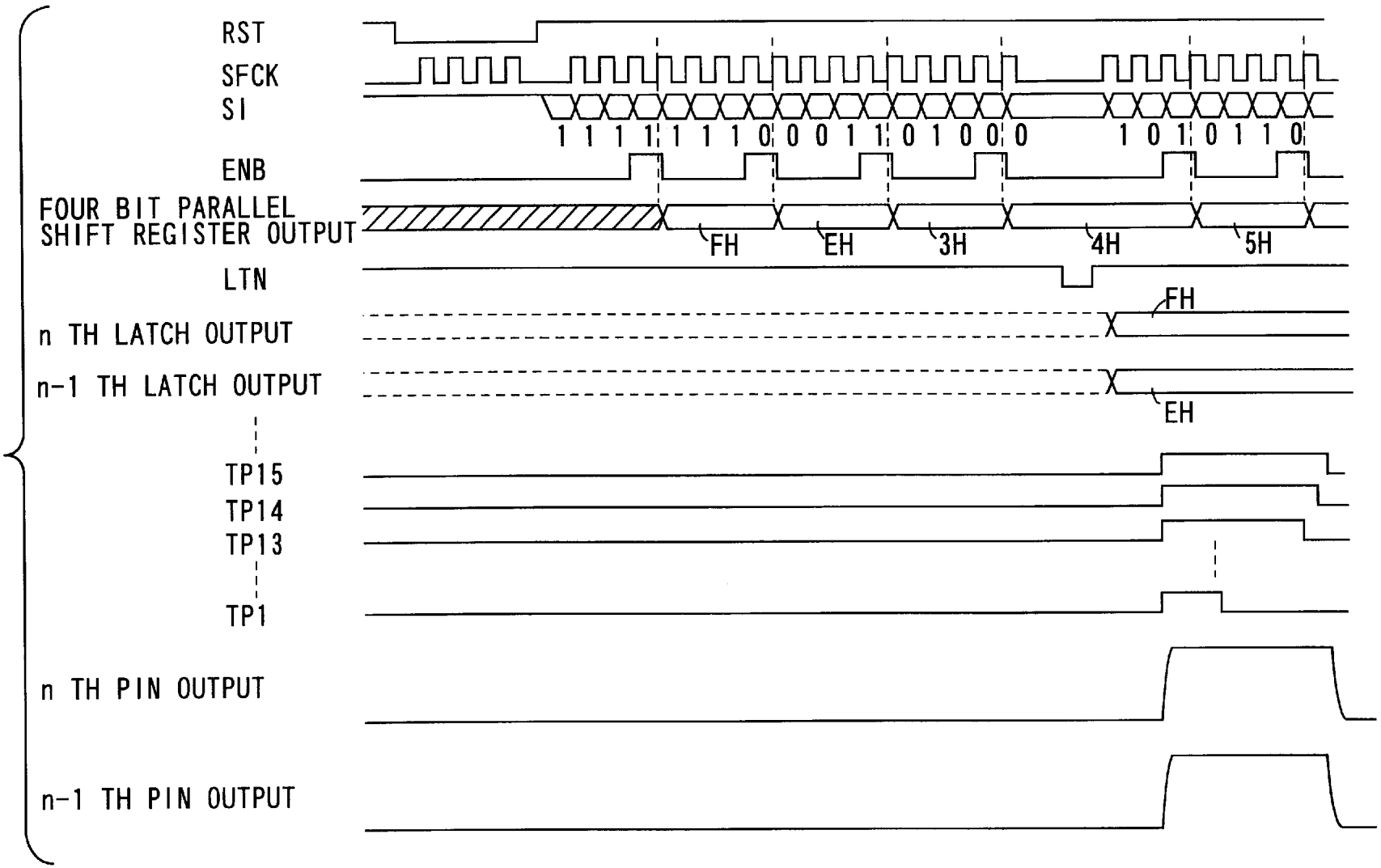
FIG. 7 is a timing waveform diagram showing operation timing when print data in which each pixel comprises four bits is handled in the second embodiment.

According to such a structure, when one pixel comprises four bits for example, the reset signal RST is brought into low level as shown in FIG. 7, and in this state, four bits mask data is supplied to the mask circuit 40 through the select circuit 39 in synchronously with the shift clock SFCK. In this manner, the mask data is set in the latch circuit 42 of the mask circuit 40.

Subsequently, after the reset signal RST rises from low level to high level, and each of the four-bit parallel shift registers 32 and the serial data output circuit 34 are initialized, the four bits serial print data SI is input in synchronously with the shift clock SFCK. The serial print data is input to the serial/parallel conversion circuit 31 through the select circuit 39, and the serial/parallel conversion circuit 31 converts it into four bits parallel print data whenever the four bits serial print data is input. This four bits parallel print data is supplied to the four-bit parallel shift register 32 of the first step through the mask circuit 40. Here, since the print data having the maximum tones of one-pixel four-bits is handled, the masking of the parallel print data by the mask circuit 40 is not carried out.

In this manner, each of the four-bit parallel shift registers 32 transfers the four bits parallel print data to the four-bit parallel shift register 32 of the next step at the input timing of the enable signal ENB for shifting data. If the shift of the four bits parallel print data to the four-bit parallel shift register 32 of the k th step is completed, parallel data from the four-bit parallel shift register 32 of the last step is converted into serial print data by the serial data output circuit 34, and is supplied to the printer head driving device of the next step.

In this manner, if the shift of data to each of the four-bit parallel shift registers 32 of the all of the printer head devices which are connected in the cascade manner is completed, and the shift of data of amount of one line is completed, the latch signal LTN is input, and print data of amount of one line is latched by the latch circuit 36. The print data of amount of one line latched by the latch circuit 36 is supplied to the conductive waveform select circuit 37 as one-pixel four-bits data. The conductive waveform select circuit 37 selects one of the conductive signals TP1 to TP15 and GND based on four bits data for each of the pixels, and supplies the selected conductive signal to the corresponding head driver 38. In this manner, the head driving signal selected for each pixel of one line is output.

As shown in FIG. 7, for example, if a latch output with respect to n th pixel is "FH", and a latch output with respect to n−1 th pixel is "EH", the conductive waveform select circuit 37 selects the conductive signal TP15 with respect to n th pixel, and selects the conductive signal TP14 with respect to n−1 th pixel. In this manner, n th pin output waveform for driving n th head element and n−1 th pin output waveform for driving n−1 th head element are generated.

Figure 8:
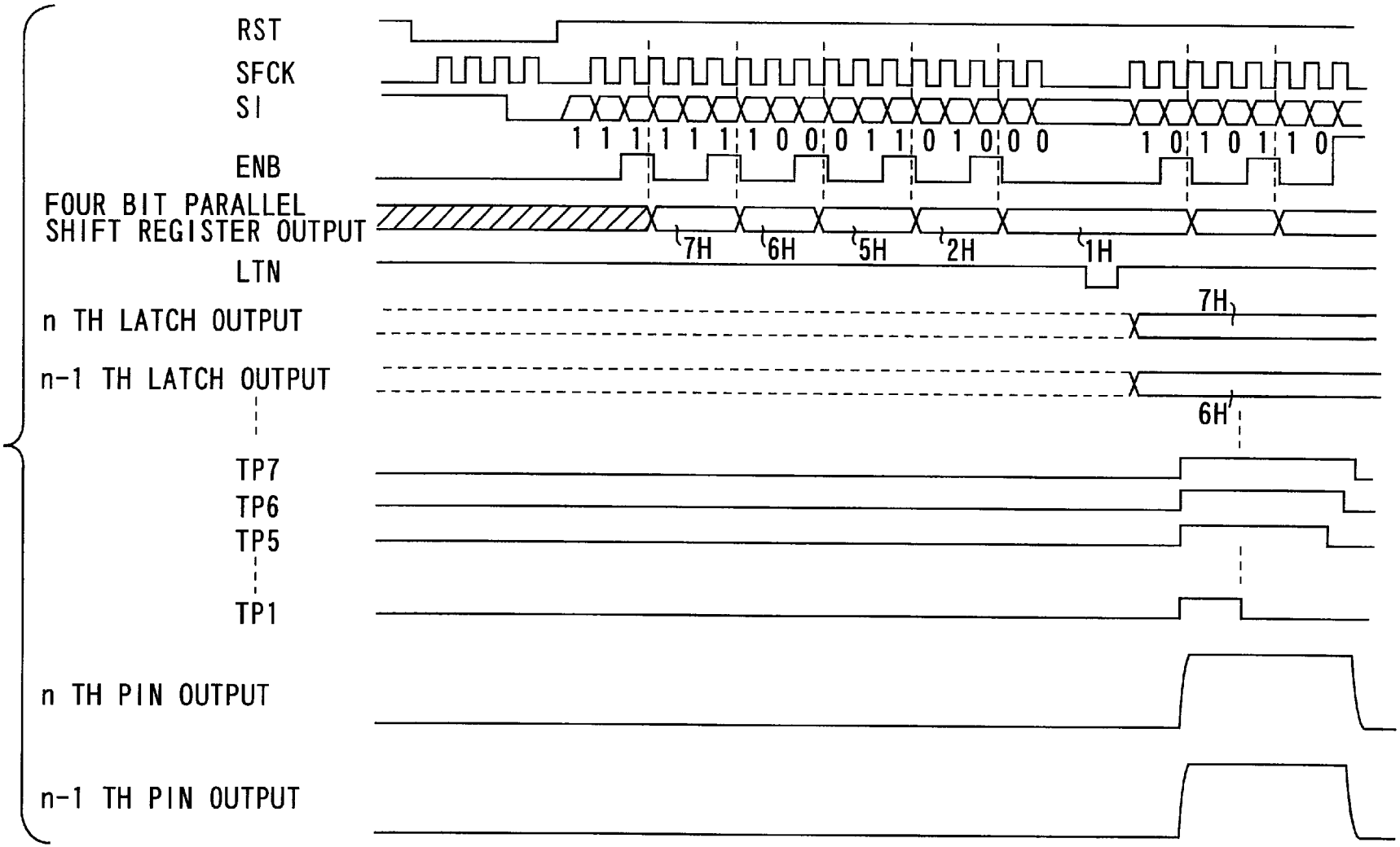
FIG. 8 is a timing waveform diagram showing operation timing when print data in which each pixel comprises three bits is handled in the second embodiment.

If one pixel comprises three bits, as shown in FIG. 8, when the reset signal RST is at low level, four bits mask data is set in the mask circuit 40 through the select circuit 39.

Subsequently, after the reset signal RST rises from low level to high level, and each of the four-bit parallel shift registers 32 and the serial data output circuit 34 are initialized, the three bits serial print data SI is input in synchronously with the shift clock SFCK. The serial print data is input to the serial/parallel conversion circuit 31 through the select circuit 39, and the serial/parallel conversion circuit 31 converts it into three bits parallel print data whenever the three bits serial print data is input.

At this time, the highest-order one bit (04) of the serial/parallel conversion circuit 31 is the lowest-order one bit of the three bits print data input immediately before.

This three bits parallel print data is supplied to the four-bit parallel shift register 32 of the first step through the mask circuit 40. The mask circuit 40 masks the upper one bit among the four bits line to forcibly bring the data to "0", and outputs only the lower three bits to the four-bit parallel shift register 32 of the first step as effective bits.

In this manner, each of the four-bit parallel shift registers 32 transfers the three-bit parallel print data to the four-bit parallel shift register 32 at the next step at the input timing of the enable signal ENB. And if the shift of the three bits parallel print data to the four-bit parallel shift register 32 of the k th step is completed, the parallel data from the four-bit parallel shift register 32 of the last step is converted into the serial print data by the serial data output circuit 34, and are supplied to the printer head driving device of the next step.

If the shift of data of amount of one line is completed in this manner, the latch signal LTN is input, and print data of amount of one line is latched by the latch circuit 36. The print data of amount of one line latched by the latch circuit 36 is supplied to the conductive waveform select circuit 37 as one-pixel three-bits data. The conductive waveform select circuit 37 selects one of the conductive signals TP1 to TP7 and GND based on three bits data for each of the pixels, and supplies the selected conductive signal to the corresponding head driver 38. That is, when one pixel comprises three bits, there are eight kinds of conductive signal (including GND) which can be selected.

In this manner, the head driving signal selected for each of pixel of one line is output.

As shown in FIG. 8, for example, if a latch output with respect to n th pixel is "7H", and a latch output with respect to n−1 th pixel is "6H", the conductive waveform select circuit 37 selects the conductive signal TP7 with respect to n th pixel, and selects the conductive signal TP6 with respect to n−1 th pixel. In this manner, n th pin output waveform for driving n th head element and n−1 th pin output waveform for driving n−1 th head element are generated.

Figure 9:
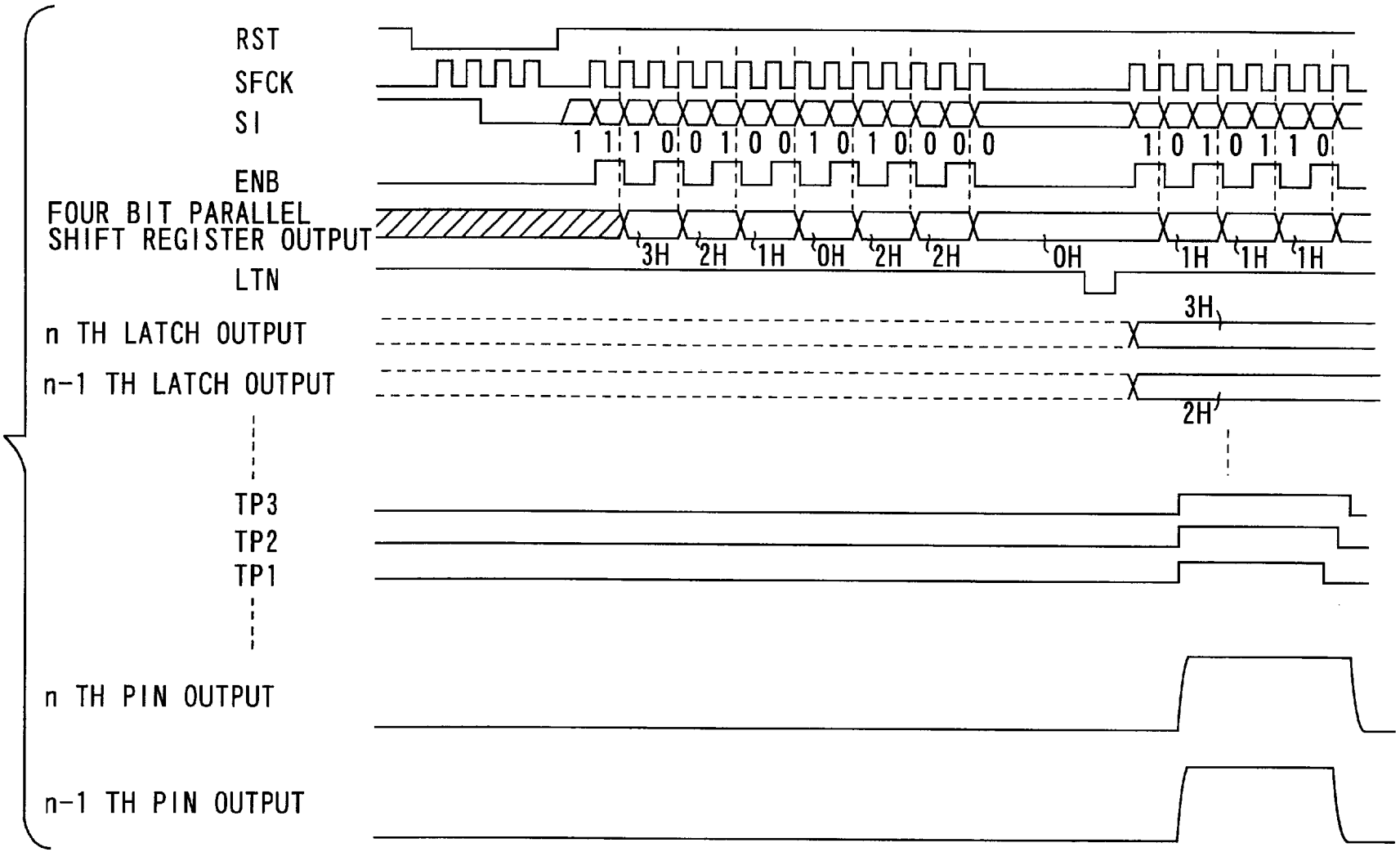
FIG. 9 is a timing waveform diagram showing operation timing when print data in which each pixel comprises two bits is handled in the second embodiment.

Further, if one pixel comprises two bits, four bits mask data is set in the mask circuit 40 through the select circuit 39 when the reset signal RST is at low level as shown in FIG. 9. This is the same as the case in which one pixel comprises four bits.

Subsequently, after the reset signal RST rises from low level to high level, and each of the four-bit parallel shift registers 32 and the serial data output circuit 34 are initialized, the two bits serial print data SI is input in synchronously with the shift clock SFCK. The serial print data is input to the serial/parallel conversion circuit 31 through the select circuit 39, and the serial/parallel conversion circuit 31 converts it into two bits parallel print data whenever the two bits serial print data is input. At this time, the higher-order two bits (03, 04) of the serial/parallel conversion circuit 31 are the two bits print data input immediate before. This two bits parallel print data is supplied to the four-bit parallel shift register 32 of the first step through the mask circuit 40. The mask circuit 40 masks the upper two bits among the four bits line to forcibly bring the data to "00", and outputs only the lower two bits as effective bits.

In this manner, two bits parallel print data is sequentially shifted and stored in each of the four-bit parallel shift registers 32. If the print data of an amount of one line has been shifted, the latch signal LTN is input, and the print data of the amount of one line is latched by the latch circuit 36. The print data of amount of one line latched by the latch circuit 36 is supplied to the conductive waveform select circuit 37 as one-pixel two-bits data. The conductive waveform select circuit 37 selects one of the conductive signals TP1 to TP3 and GND based on two bits data for each of the pixels, and supplies the selected conductive signal to the corresponding head driver 38. When one pixel comprises two bits, there are four kinds of conductive signal (including GND) which can be selected. In this manner, the head driving signal selected for each of pixel of one line is output.

As shown in FIG. 9, for example, if a latch output with respect to n th pixel is "3H", and a latch output with respect to n−1 th pixel is "2H", the conductive waveform select circuit 37 selects the conductive signal TP3 with respect to n th pixel, and selects the conductive signal TP2 with respect to n−1 th pixel. In this manner, n th pin output waveform for driving n th head element and n−1 th pin output waveform for driving n−1 th head element are generated.

Figure 10:
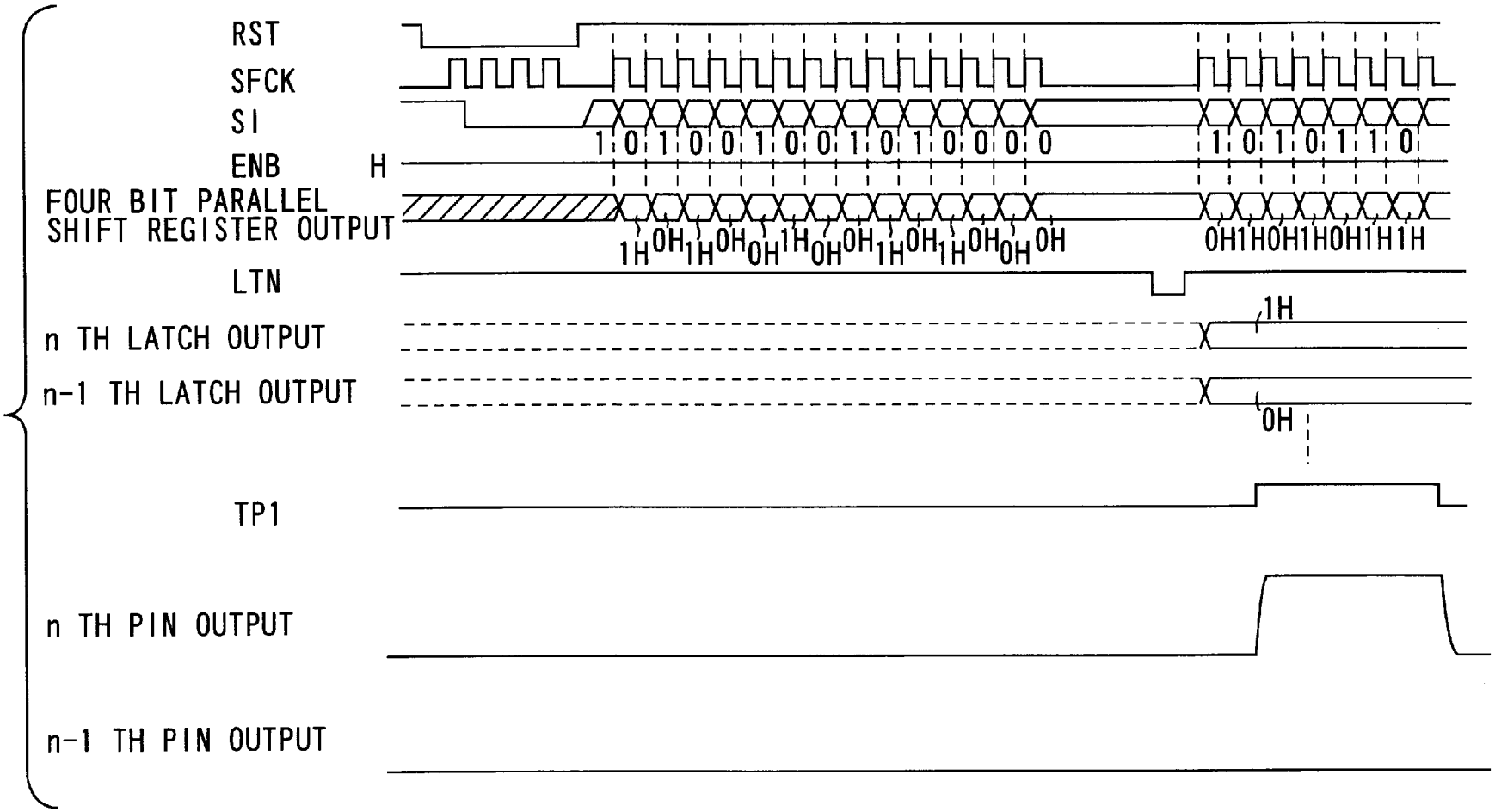
FIG. 10 is a timing waveform diagram showing operation timing when print data in which each pixel comprises one bit is handled in the second embodiment.

Further, if one pixel comprises one bit, four bits mask data is set in the mask circuit 40 through the select circuit 39 when the reset signal RST is at low level as shown in FIG. 10.

Subsequently, after the reset signal RST rises from low level to high level, and each of the four-bit parallel shift registers 32 and the serial data output circuit 34 are initialized, the one bit serial print data SI is input in synchronously with the shift clock SFCK. The serial print data is input to the serial/parallel conversion circuit 31 through the select circuit 39, and the serial/parallel conversion circuit 31 outputs this one bit serial print data as it is. At this time, the higher-order three bits (02, 03, 04) of the serial/parallel conversion circuit 31 correspond to print data input in the order before the one bit serial print data (04 is data input immediately before the one bit serial print data). This one bit parallel print data is supplied to the four-bit parallel shift register 32 of the first step through the mask circuit 40. The mask circuit 40 masks the upper three bits among the four bits line to forcibly bring the data to "000", and outputs only the lower one bit as effective bit.

In this manner, one bit parallel print data is sequentially shifted and stored in each of the four-bit parallel shift registers 32. If the print data of an amount of one line has been shifted, the latch signal LTN is input, and the print data of the amount of one line is latched by the latch circuit 36.

The print data of amount of one line latched by the latch circuit 36 is supplied to the conductive waveform select circuit 37 as one-pixel one-bit data. The conductive waveform select circuit 37 selects one of the conductive signal TP1 and GND based on one bit data for each of the pixels, and supplies the selected conductive signal to the corresponding head driver 38. In this manner, the head driving signal selected for each of pixel of one line is output.

For example, as shown in FIG. 10, if the latch output with respect to n th pixel is "1H", and the latch output with respect to n−1 th pixel is "0H", the conductive waveform select circuit 37 selects the conductive signal TP1 with respect to n th pixel, and selects the GND with respect to n−1 th pixel. In this manner, n th pin output waveform for driving n th head element and n−1 th pin output waveform for driving n−1 th head element are generated. The n th pin output waveform is the waveform of the signal TP1, and the n−1 th pin output waveform is a zero output waveform.

Therefore, in this embodiment also, since data can be transferred in series to the printer head driving device, the number of signal lines used for data transfer can be only one. Further, when serial print data at the maximum four bits tone can be received, even if the situation is changed such that two bits tone serial print data or one bit serial print data of two values is handed, it is unnecessary to add and transfer dummy data. Therefore, as the print data has smaller bit, the data transfer time can be shortened, and data can be printed faster.

Figure 11:
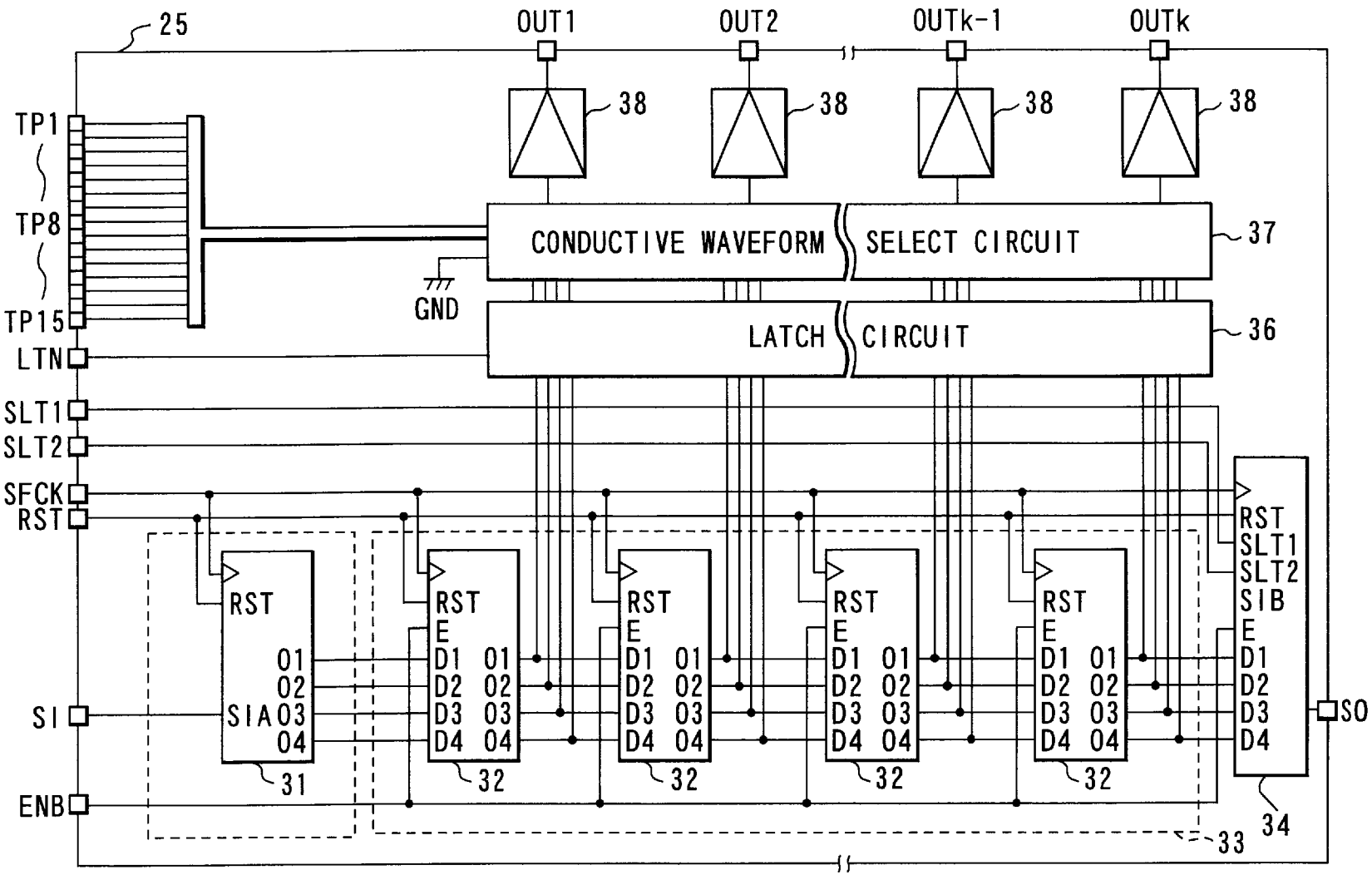
FIG. 11 is a circuit block diagram showing a third embodiment of the invention.

Next, a third embodiment of the present invention will be explained with reference to FIGS. 11 and 12. In FIG. 11, the control section 26 shown in FIG. 1 is omitted.

Elements similar to those in the above described first embodiment are designated by the same reference numerals, and portions different from the first embodiment will be described. In the third embodiment, as shown in FIG. 11, the basic circuit structure is the same as that of the first embodiment except the mask circuit. The third embodiment is different from the first embodiment in that the mask circuit is omitted, and the setting method of the conductive signals TP1 to TP15 and the GND is changed.

That is, when one pixel comprises four bits, a different conductive waveform is set for each of the conductive signals TP1 to TP15, and the conductive waveform select circuit 37 selects one of the conductive signals TP1 to TP15 and the GND based on the one-pixel four-bit data from the latch circuit 36.

Therefore, the operation at that time is the same as the case in which one pixel comprises four bits in the first embodiment.

Further, when one pixel comprises two bits, each of the conductive signals TP4, TP8 and TP12 is set to the same state as the GND such that the conductive waveform select circuit 37 selects the conductive waveform of the GND when four bits data which are input to the conductive waveform select circuit 37 are OH, 4H, 8H and CH. Also, when the four bits data are 1H, 5H, 9H and DH, each of the conductive signals TP5, TP9 and TP13 are set to the same state as the TP1 such that the conductive waveform select circuit 37 selects the conductive waveform of the TP1. Further, when the four bits data are 2H, 6H, AH and EH, each of the conductive signals TP6, TP10 and TP14 are set to the same state as the TP2 such that the conductive waveform select circuit 37 selects the conductive waveform of the TP2. Further, when the four bits data are 3H, 7H, BH and FH, each of the conductive signals TP7, TP11 and TP15 are set to the same state as the TP3 such that the conductive waveform select circuit 37 selects the conductive waveform of the TP3.

In the operation at that time, even if the upper two bits among the four bits are not masked intentionally, the conductive waveform can be selected using the lower two bits data only irrespective of the values of these two bits. That is, among the four bits, only the lower two bits are effective and the upper two bits are invalid substantially.

Therefore, in such a case, one-pixel two-bits tone can be printed if two bits serial print data is input.

Further, when one pixel comprises one bit, the conductive signals TP2, TP4, TP4, TP6, TP8, TP10, TP12 and TP14 are set to the same state as the GND such that the conductive waveform select circuit 37 selects the conductive waveform of the GND when the four bits data which are input to the conductive waveform select circuit 37 are OH, 2H, 4H, 6H, 8H, AH, CH and EH. The conductive signals TP3, TP5, TP7, TP9, TP11, TP13 and TP15 are set to the same state as the TP1 such that the conductive waveform select circuit 37 selects the conductive waveform of TP1 when the four bits data are 1H, 3H, 5H, 7H, 9H, BH, DH and FH.

In the operation at that time, even if the upper three bits among the four bits are not masked intentionally, the conductive waveform can be selected using the lower one bit data only irrespective of the values of these three bits. That is, among the four bits, only the lower one bit is effective and the upper three bits are invalid substantially.

Therefore, in such a case, two values can be printed if one bit serial print data is input.

Figure 12:
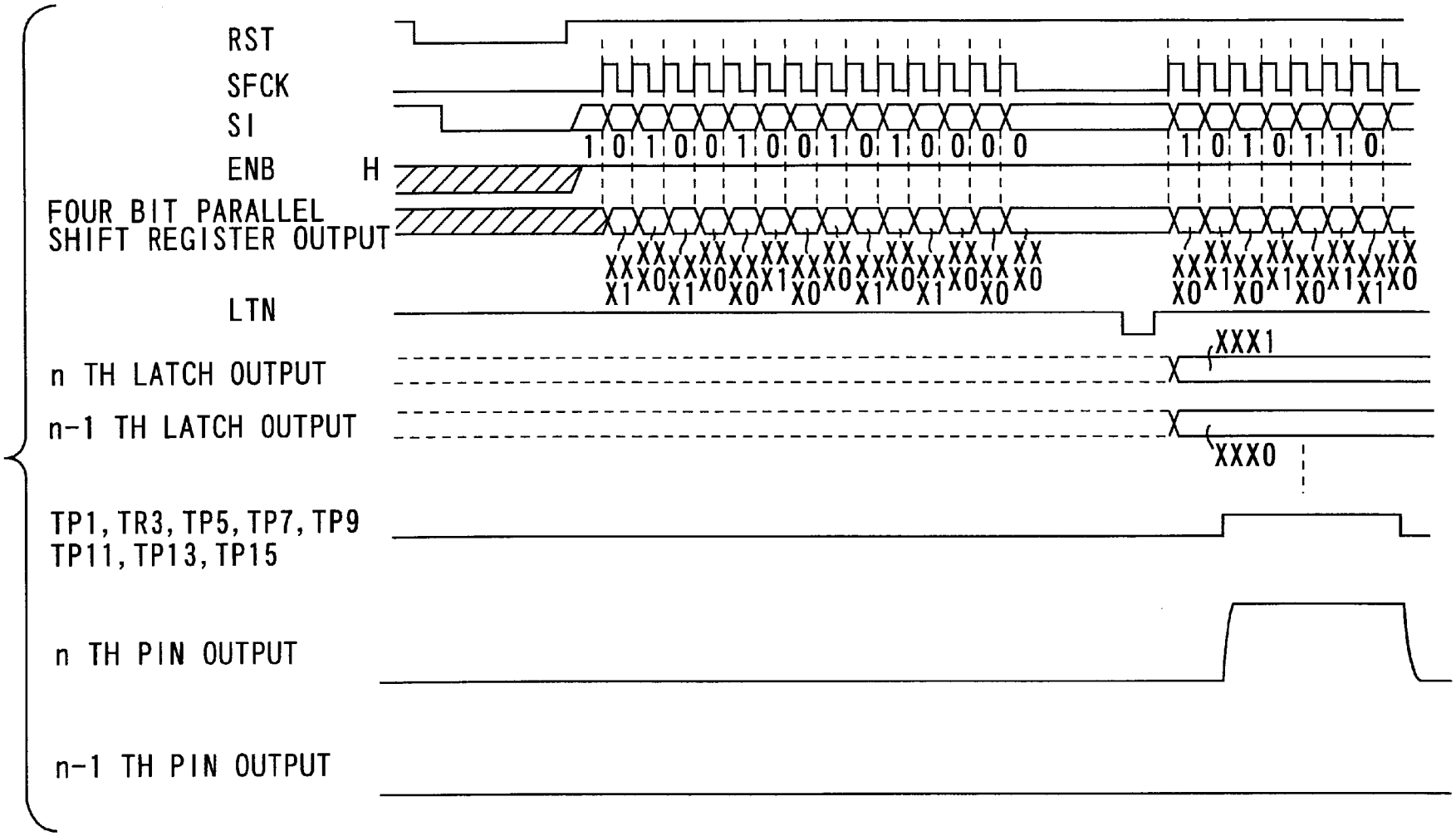
FIG. 12 is a timing waveform diagram showing operation timing when print data in which each pixel comprises one bit is handled in the third embodiment.

The operation timing when one pixel comprises one bit is as shown in FIG. 12. For example, if the latch output with respect to n th pixel is "xxx1" and the latch output with respect to n−1 th pixel is "xxx0", the conductive waveform select circuit 37 selects any one of the conductive signals TP1, TP3, TP5, TP7, TP9, TP11, TP13 and TP15 with respect to the n th pixel and selects the conductive waveform corresponding to the conductive signal TP1, and selects any one of the conductive signals GND, TP2, TP4, TP6, TP8, TP10, TP12 and TP14 with respect to the n−1 th pixel and selects the conductive waveform corresponding to the conductive signal GND. In this manner, n th pin output waveform for driving n th head element and n−1 th pin output waveform for driving n−1 th head element are generated. The n th pin output waveform is the waveform equal to the signal TP1, and the n−1 th pin output waveform is a zero output waveform.

Therefore, in this embodiment also, since data can be transferred in series to the printer head driving device, the number of signal lines used for data transfer can be only one. Further, when serial print data at the maximum four bits tone can be received, even if the situation is changed such that two bits tone serial print data or one bit serial print data of two values is handed, it is unnecessary to add and transfer dummy data. Therefore, as the print data has smaller bit, the data transfer time can be shortened, and data can be printed faster.

Figure 13:
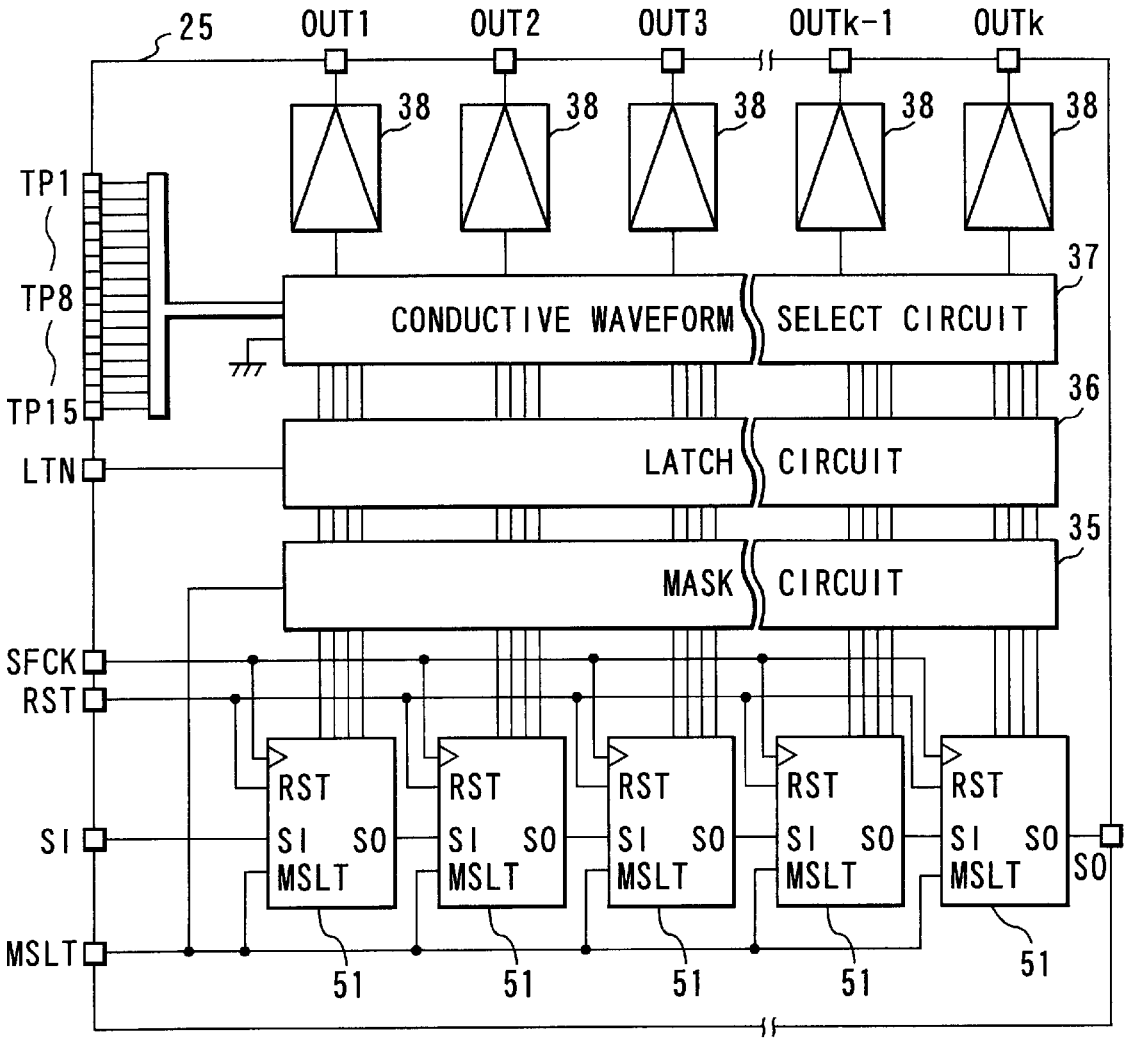
FIG. 13 is a circuit block diagram showing a fourth embodiment of the invention.

Next, a fourth embodiment of the present invention will be explained with reference to FIGS. 13 to 16. In FIG. 13, the control section 26 shown in FIG. 1 is omitted.

Elements similar to those in the above described first embodiment are designated by the same reference numerals, and portions different from the first embodiment will be described. In the fourth embodiment, as shown in FIG. 13, shift registers 51 having selectors are used instead of the serial/parallel conversion circuit 31, each of the four-bit parallel shift registers 32 and the serial data output circuit 34.

Figure 14:
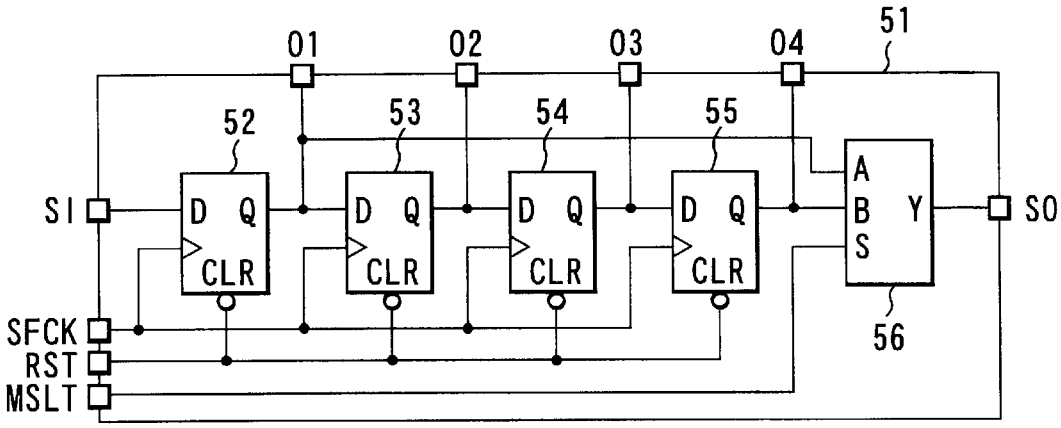
FIG. 14 is a block diagram showing a structure of a shift register with a selector.

As shown in FIG. 14, each of the shift registers 51 having selectors comprises a select circuit 56 and a shift register group having four steps of D-type flip-flops 52 to 55 which are connected to one another in series, and sequentially shifts m bit tone serial print data SI to the four steps of the D-type flip-flops 52 to 55 in synchronously with the shift clock SFCK.

When the control signal MSLT is at low level, the select circuit 56 selects an output of the flip-flop 55 of the last step and outputs the same from an output terminal Y to an output terminal SO of the shift register 51, and when the control signal MSLT is at high level, the select circuit 56 selects an output of the flip-flop 52 and outputs the same from the output terminal Y to the output terminal SO of the shift register 51. An output of each of the flip-flops 52 to 55 is output to the mask circuit 35 through output terminals O1 to O4.

In such a structure, when one pixel comprises four bits for example, four bits serial print data SI is input, and at that time, the control signal MSLT is at low level, and the select circuit 56 selects an output of the flip-flop 55 of the last step and outputs the same from the output terminal Y.

Figure 15:
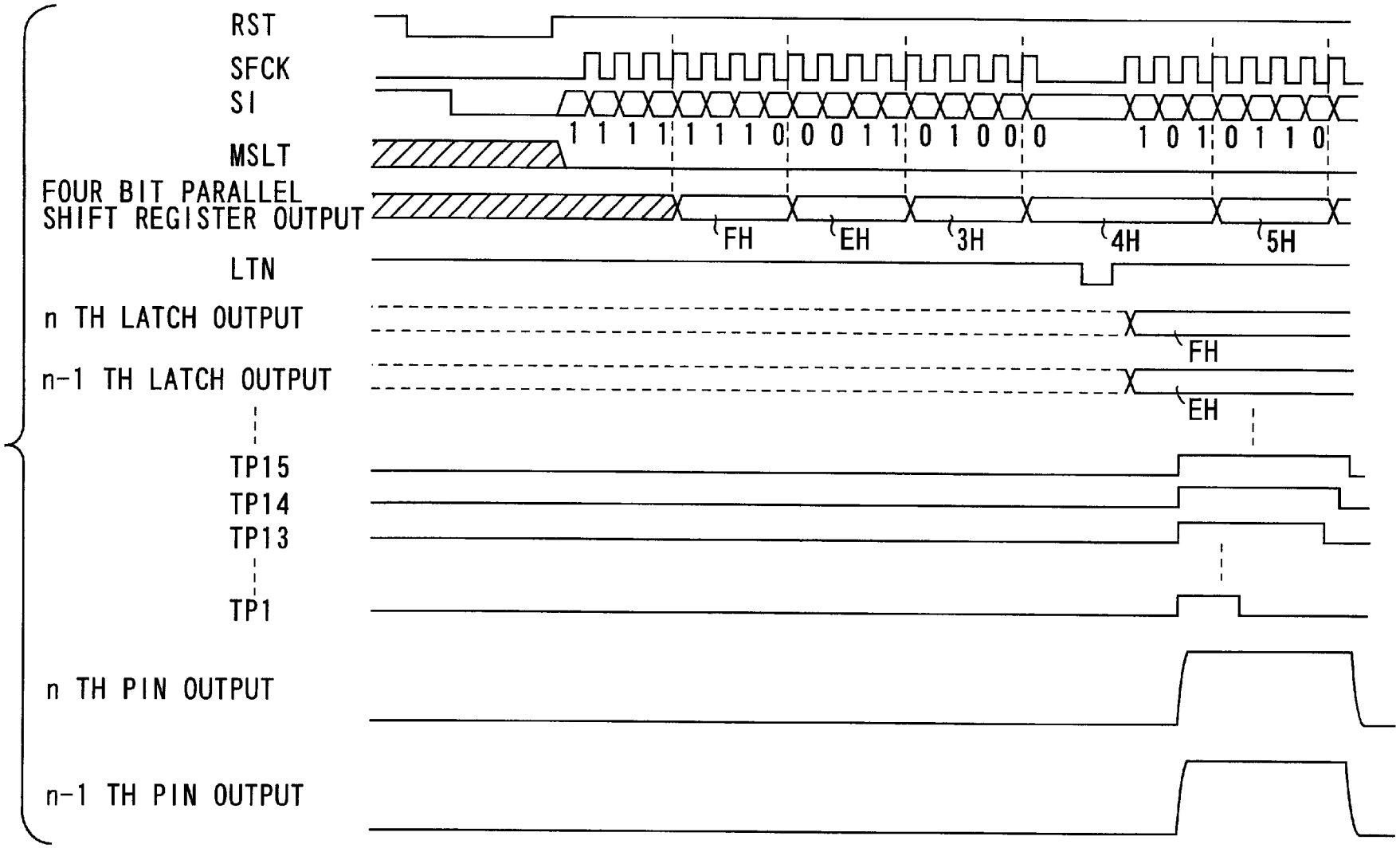
FIG. 15 is a timing waveform diagram showing operation timing when print data in which each pixel comprises four bits is handled in the fourth embodiment.

The operation timing of each of parts is as shown in FIG. 15. That is, if the reset signal RST rises from low level to high level, each of shift registers 51 having selectors is initialized, each of the shift registers 51 having selectors stores the serial print data four bits by four bits while sequentially shifting the data.

If the shift of serial print data to the shift register 51 having the selector of k th step is completed, data is supplied from the shift register 51 having the selector of the last step to the printer head driving device of the next step, and the shift of data is carried out also in the next step.

If the shift of the print data from all of the printer head driving devices which are connected to one another in the cascade manner to each of the shift registers 51 having selectors is completed, and the shift of amount of one line is completed, the latch signal LTN is input, and the print data of amount of one line is latched by the latch circuit 36 through the mask circuit 35 from the output terminals O1 to O4 of each of the shift registers 51 having selectors. Since print data having the maximum tones of one-pixel four-bits is handled this time, the masking by the mask circuit 35 is not carried out.

The print data of the amount of one line latched by the latch circuit 36 is supplied to the conductive waveform select circuit 37 as four bits pixel data. The conductive waveform select circuit 37 selects one of conductive signals TP1 to TP15 and the GND, and the selected conductive signal is supplied to the corresponding head driver 38. In this manner, the head driving signal selected for each of pixels of one line is output.

As shown in FIG. 15, for example, if a latch output with respect to n th pixel is "FH", and a latch output with respect to n−1 th pixel is "EH", the conductive waveform select circuit 37 selects the conductive signal TP15 with respect to n th pixel, and selects the conductive signal TP14 with respect to n−1 th pixel. In this manner, n th pin output waveform for driving n th head element and n−1 th pin output waveform for driving n−1 th head element are generated.

Further, when one pixel comprises one bit, one bit serial print data SI is input, and at that time, the control signal MSLT is at high level, and the select circuit 56 selects an output of the flip-flop of the first step and outputs the same from the output terminal Y.

Figure 16:
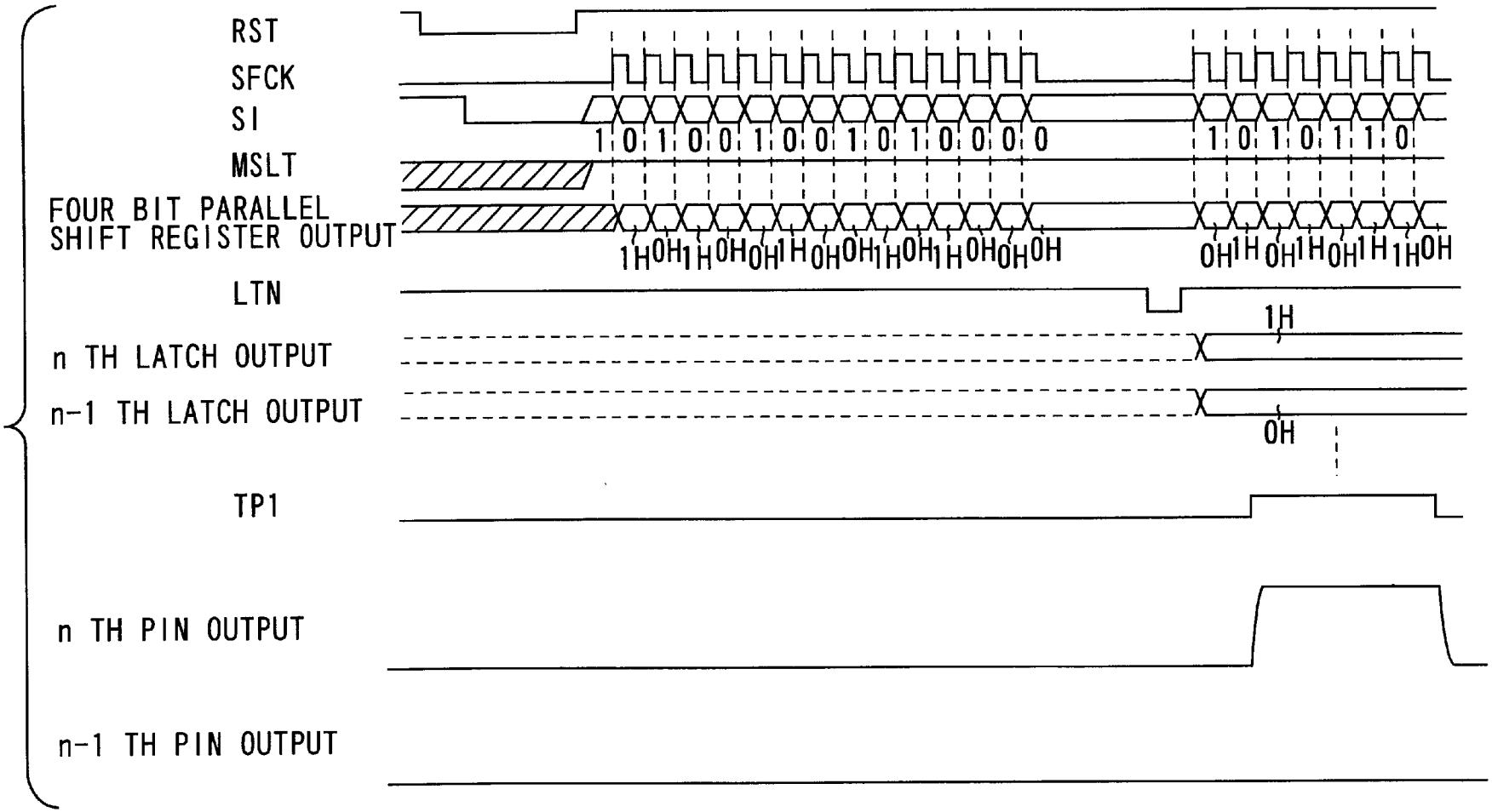
FIG. 16 is a timing waveform diagram showing operation timing when print data in which each pixel comprises one bit is handled in the fourth embodiment.

The operation timing of each of the parts is as shown in FIG. 16. That is, if the reset signal rises from low level to high level, each of the shift registers 51 having selectors is initialized. In this state, if the serial print data SI and the shift clock SFCK are input, each of the shift registers 51 having selectors stores the serial print data in the flip-flop 52 of the first step and then, shifts the output of the flip-flop 52 to the shift register 51 having the selector of the next step.

If the shift of serial print data to the shift register 51 having the selector of k th step is completed, data is supplied from the shift register 51 having the selector of the last step to the printer head driving device of the next step, and the shift of data is carried out also in the next step.

If the shift of the print data from all of the printer head driving devices which are connected to one another in the cascade manner to each of the shift registers 51 having selectors is completed, and the shift of amount of one line is completed, the latch signal LTN is input, and the print data of amount of one line is latched by the latch circuit 36 through the mask circuit 35 from the output terminals O1 to O4 of each of the shift registers 51 having selectors. At that time, the mask circuit 35 makes only the bit data from the output terminal O1 effective, and masks the outputs from the output terminals O2 to O4 to zero.

Therefore, the data to be latched by the latch circuit 36 becomes one bit data in which one pixel is represented by 1H or 0H. The print data of the amount of one line latched by the latch circuit 36 is supplied to the conductive waveform select circuit 37 as one-pixel one-bit data. The conductive waveform select circuit 37 selects one of conductive signals TP1 and the GND, and the selected conductive signal is supplied to the corresponding head driver 38. The head driving signal selected for each of pixel in one line is output in this manner.

As shown in FIG. 16, for example, if a latch output with respect to n th pixel is "1H", and a latch output with respect to n−1 th pixel is "0H", the conductive waveform select circuit 37 selects the conductive signal TP1 with respect to n th pixel, and selects the GND with respect to n−1 th pixel. In this manner, n th pin output waveform for driving n th head element and n−1 th pin output waveform for driving n−1 th head element are generated.

Therefore, in this embodiment also, since data can be transferred in series to the printer head driving device, the number of signal lines used for data transfer can be only one. Further, when serial print data at the maximum four bits tone can be received, even if the situation is changed such that one bit serial print data of two values is handed, it is unnecessary to add and transfer dummy data. Therefore, as the print data has smaller bit, the data transfer time can be shortened, and data can be printed faster.

Figure 17:
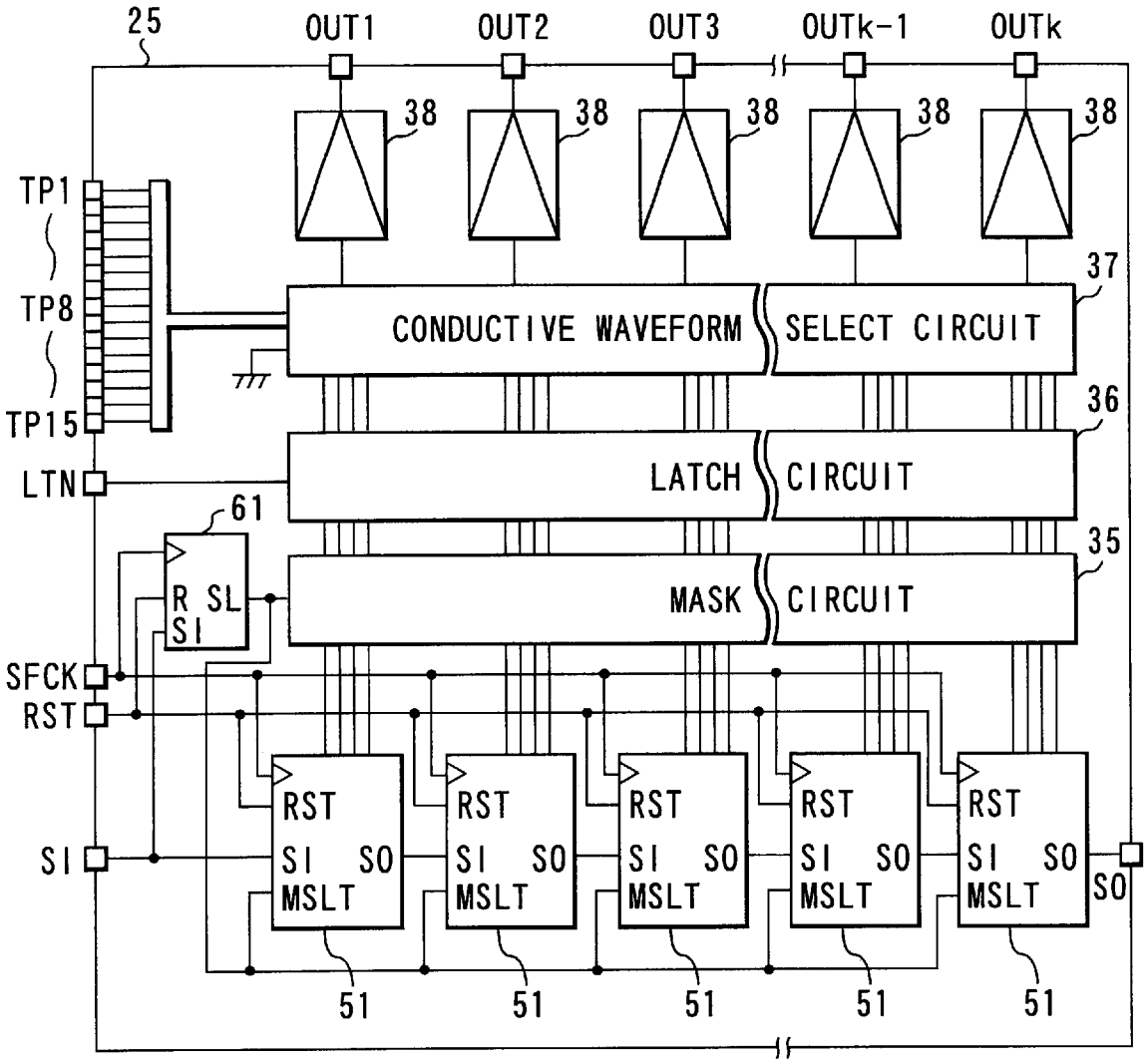
FIG. 17 is a circuit block diagram showing a fifth embodiment of the invention.

Next, a fifth embodiment of the present invention will be explained with reference to FIGS. 17 to 20. In FIG. 17, the control section 26 shown in FIG. 1 is omitted.

Elements similar to those in the above described fourth embodiment are designated by the same reference numerals, and portions different from the first embodiment will be described. In the present embodiment, as shown in FIG. 17, a mask setting circuit 61 is newly provided, and the reset signal RST, the shift clock SFCK and the data SI are input to this mask setting circuit 61, an output SL from the mask setting circuit 61 is supplied to the mask circuit 35, and the output SL is supplied to the shift registers 51 having selectors as the control signal MSLT.

Figure 18:
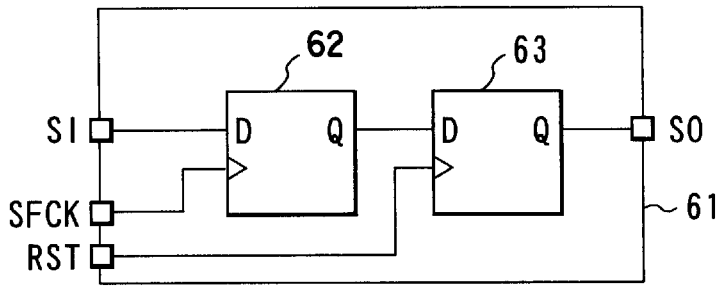
FIG. 18 is a diagram showing a structure of a mask setting circuit of the fifth embodiment.

As shown in FIG. 18, the mask setting circuit 61 comprises two steps of D-type flip-flops 62 and 63 which are connected in series, the shift clock SFCK and the data SI are input to the flip-flop 62 at the first step, and the reset signal RST is input to the flip-flop 63 of the second step. An output of the flip-flop 63 of the second step is used as a signal SL.

In such a structure, when the reset signal RST is at low level, step-number setting data of the mask data and the shift register is input to the mask setting circuit 61 in synchronously with the shift clock SFCK, and when the reset signal RST rises, the data is latched by the flip-flop 63 and is supplied to the mask circuit 35 and each of the shift registers 51 having selectors as the signal SL. When this signal SL is at low level, a circuit setting for coping with one-pixel four-bits is carried out, and the signal SL is at high level, a circuit setting for coping with one-pixel one-bit is carried out.

For example, when one pixel comprises four bits, four bits serial print data SI is input, and at that time, the control signal MSLT is at low level, and a select circuit 56 of the shift register 51 having the selector selects an output of the flip-flop 55 of the last step and outputs the same from the output terminal Y.

Figure 19:
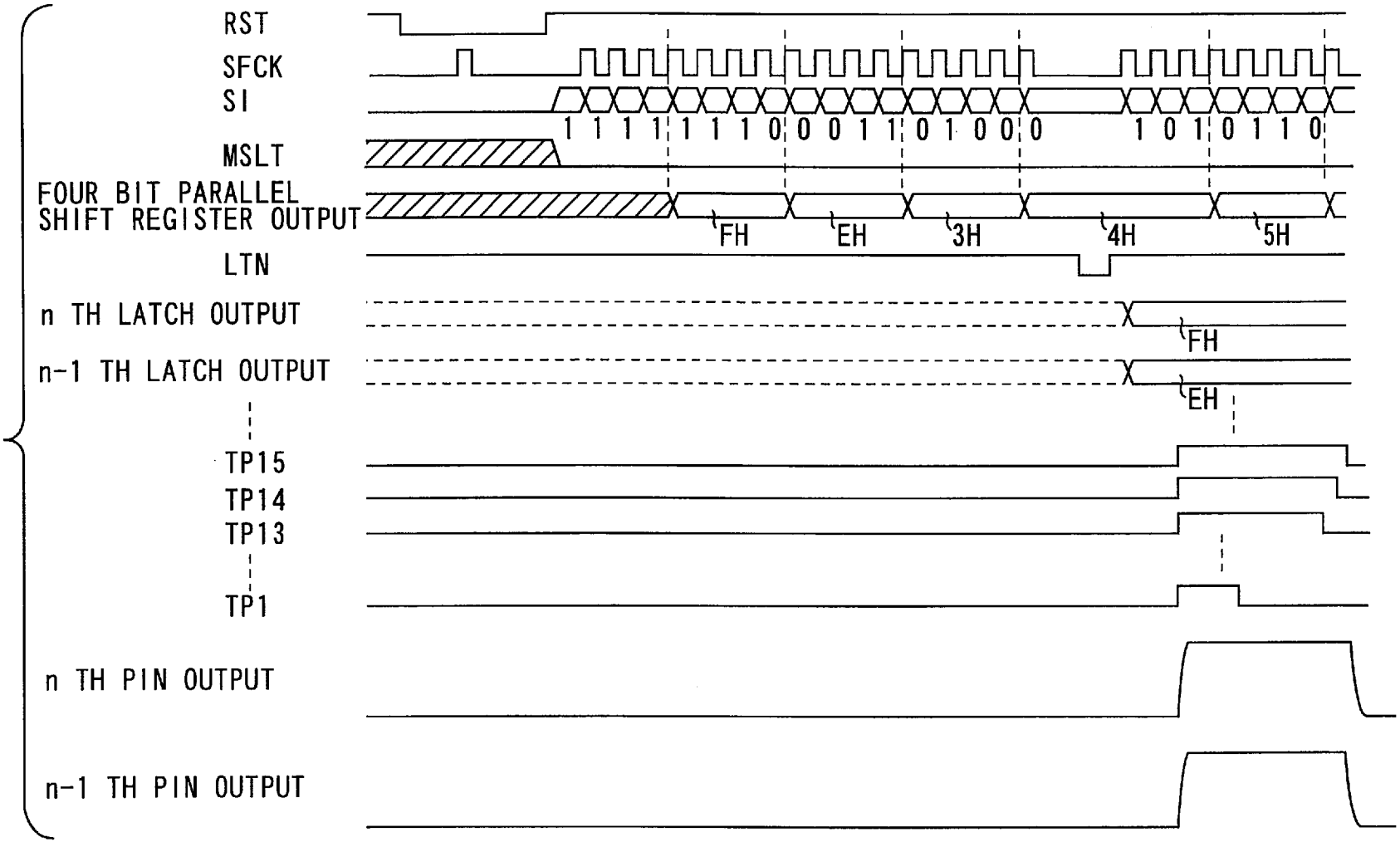
FIG. 19 is a timing waveform diagram showing operation timing when print data in which each pixel comprises four bits is handled in the fifth embodiment.

The operation timing of each of parts at that time is as shown in FIG. 19. That is, when the reset signal RST rises from low level to high level, each of the shift registers 51 having selectors is initialized, and in this state, if the serial print data SI and the shift clock SFCK are input, each of the shift registers 51 having selectors stores the serial print data four bits by four bits while sequentially shifting the data.

If the shift of serial print data to the shift register 51 having the selector of k th step is completed, data is supplied from the shift register 51 having the selector of the last step to the printer head driving device of the next step, and the shift of data is carried out also in the next step.

If the shift of the print data from all of the printer head driving devices which are connected to one another in the cascade manner to each of the shift registers 51 having selectors is completed, and the shift of amount of one line is completed, the latch signal LTN is input, and the print data of amount of one line is latched by the latch circuit 36 through the mask circuit 35 from the output terminals O1 to O4 of each of the shift registers 51 having selectors. Since print data having the maximum tones of one-pixel four-bits is handled this time, the masking by the mask circuit 35 is not carried out.

The print data of the amount of one line latched by the latch circuit 36 is supplied to the conductive waveform select circuit 37 as four bits pixel data. The conductive waveform select circuit 37 selects one of conductive signals TP1 to TP15 and the GND, and the selected conductive signal is supplied to the corresponding head driver 38. In this manner, the head driving signal selected for each of pixels of one line is output.

As shown in FIG. 19, for example, if a latch output with respect to n th pixel is "FH", and a latch output with respect to n−1 th pixel is "EH", the conductive waveform select circuit 37 selects the conductive signal TP15 with respect to n th pixel, and selects the conductive signal TP14 with respect to n−1 th pixel. In this manner, n th pin output waveform for driving n th head element and n−1 th pin output waveform for driving n−1 th head element are generated.

Further, when one pixel comprises one bit, one bit serial print data SI is input, and at that time, the control signal MSLT is at high level, and the select circuit 56 selects an output of the flip-flop of the first step and outputs the same from the output terminal Y.

Figure 20:
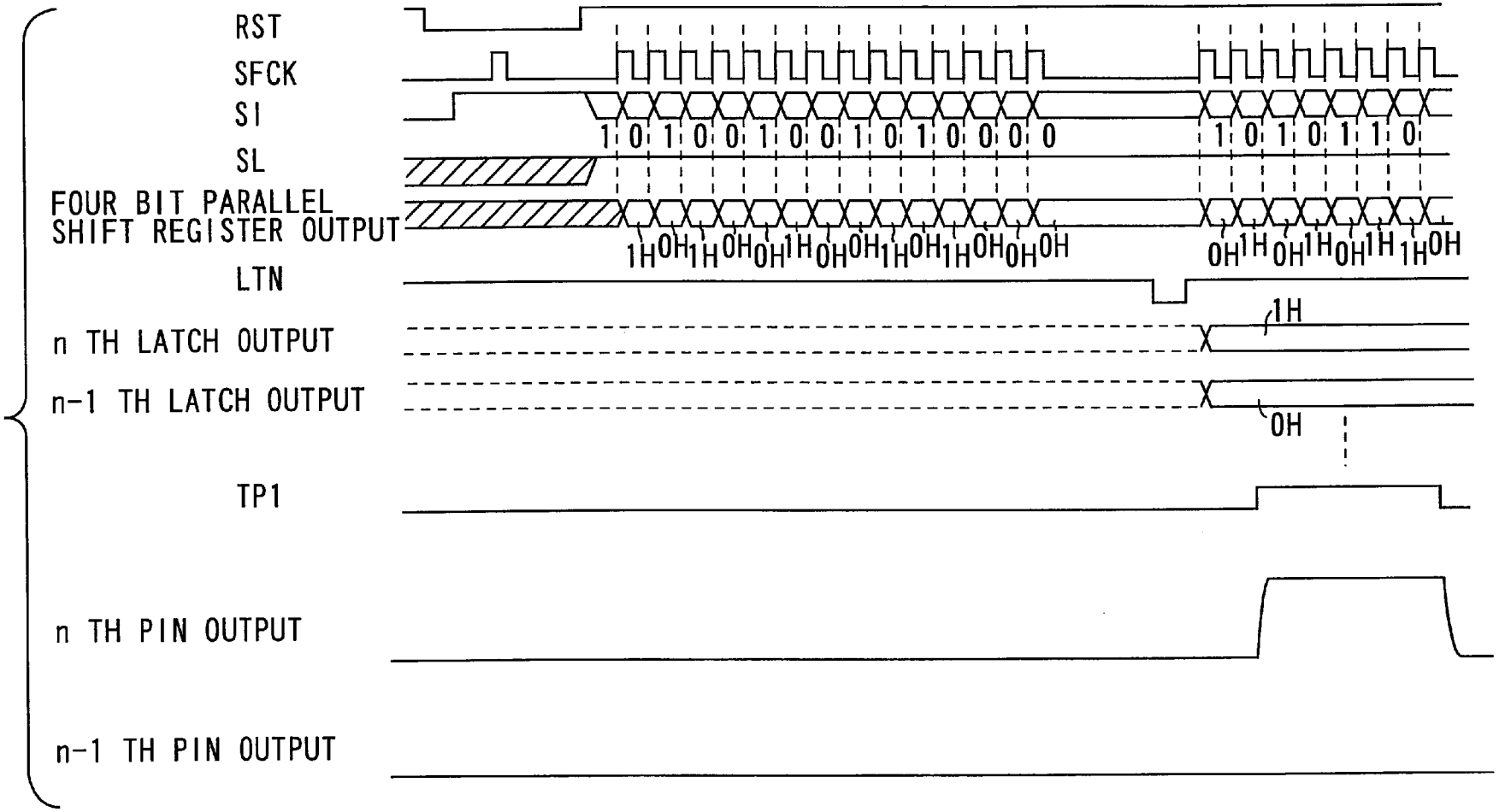
FIG. 20 is a timing waveform diagram showing operation timing when print data in which each pixel comprises one bit is handled in the fifth embodiment.

The operation timing of each of the parts is as shown in FIG. 20. That is, when the reset signal rises from low level to high level, each of the shift registers 51 having selectors is initialized. In this state, if the serial print data SI and the shift clock SFCK are input, each of the shift registers 51 having selectors stores the serial print data in the flip-flop 52 of the first step and then, shifts the output of the flip-flop 52 to the shift register 51 having the selector of the next step.

If the shift of serial print data to the shift register 51 having the selector of k th step is completed, data is supplied from the shift register 51 having the selector of the last step to the printer head driving device of the next step, and the shift of data is carried out also in the next step.

If the shift of the print data from all of the printer head driving devices which are connected to one another in the cascade manner to each of the shift registers 51 having selectors is completed, and the shift of amount of one line is completed, the latch signal LTN is input, and the print data of amount of one line is latched by the latch circuit 36 through the mask circuit 35 from the output terminals O1 to O4 of each of the shift registers 51 having selectors. At that time, the mask circuit 35 makes only the bit data from the output terminal O1 effective, and masks the outputs from the output terminals O2 to O4 to zero.

Therefore, the data to be latched by the latch circuit 36 becomes one bit data in which one pixel is represented by 1H or 0H. The print data of the amount of one line latched by the latch circuit 36 is supplied to the conductive waveform select circuit 37 as one-pixel one-bit data. The conductive waveform select circuit 37 selects one of conductive signals TP1 and the GND, and the selected conductive signal is supplied to the corresponding head driver 38. The head driving signal selected for each of pixel in one line is output in this manner.

As shown in FIG. 20, for example, if a latch output with respect to n th pixel is "1H", and a latch output with respect to n−1 th pixel is "0H", the conductive waveform select circuit 37 selects the conductive signal TP1 with respect to n th pixel, and selects the GND with respect to n−1 th pixel. In this manner, n th pin output waveform for driving n th head element and n−1 th pin output waveform for driving n−1 th head element are generated.

Therefore, in this embodiment also, since data can be transferred in series to the printer head driving device, the number of signal lines used for data transfer can be only one. Further, when serial print data at the maximum four bits tone can be received, even if the situation is changed such that one bit serial print data of two values is handed, it is unnecessary to add and transfer dummy data. Therefore, as the print data has smaller bit, the data transfer time can be shortened, and data can be printed faster.

Figure 21:
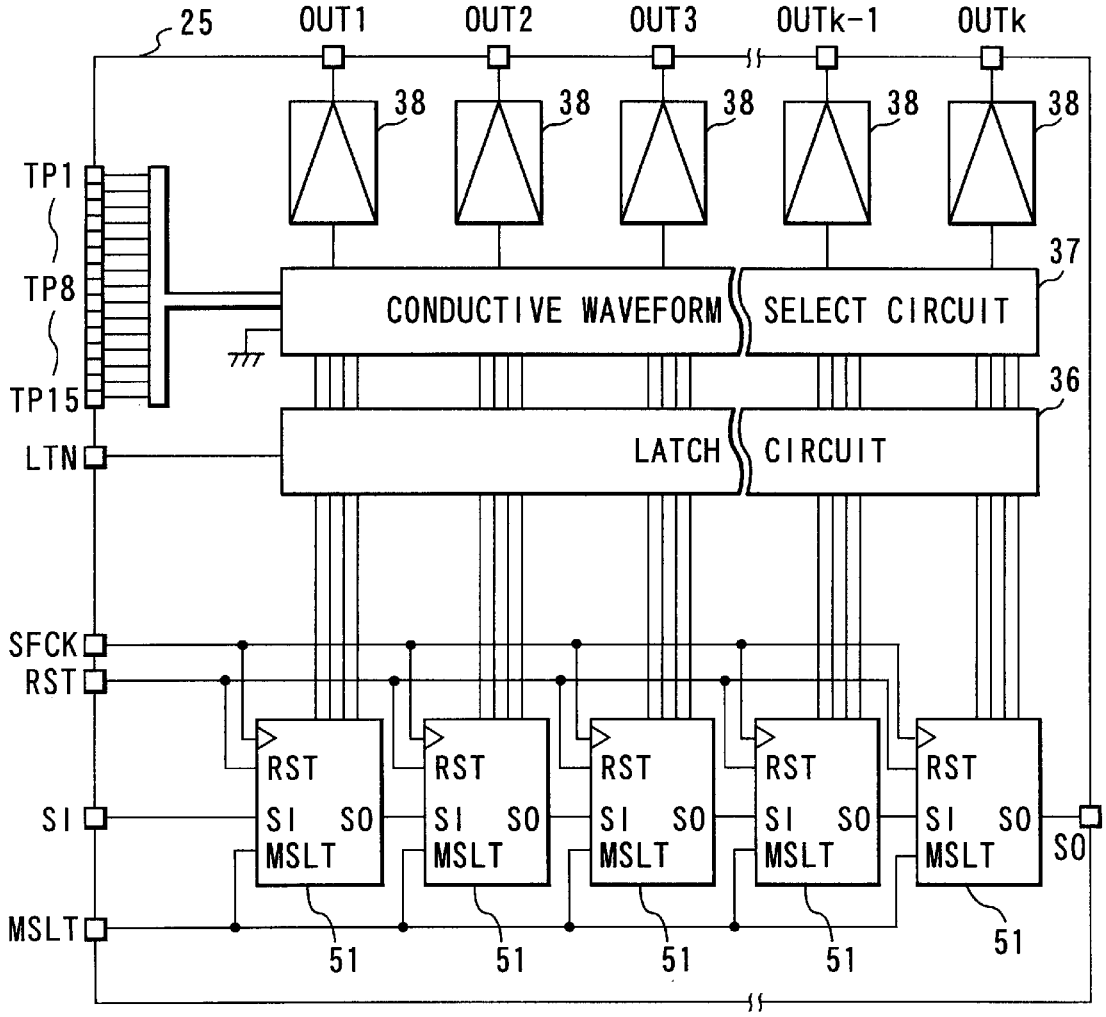
FIG. 21 is a circuit block diagram showing a sixth embodiment of the invention.

Next, a sixth embodiment of the present invention will be explained with reference to FIGS. 21 and 22. In FIG. 21, the control section 26 shown in FIG. 1 is omitted.

Elements similar to those in the above described fourth embodiment are designated by the same reference numerals, and portions different from the first embodiment will be described. In the present embodiment, as shown in FIG. 21, the basic circuit structure is the same as that of the fourth embodiment except the mask circuit. The present embodiment is different in that the mask circuit is omitted and the setting method of the conductive signals TP1 to TP15 and the GND is changed.

That is, when one pixel comprises four bits, a different conductive waveform is set for each of the conductive signals TP1 to TP15, and the conductive waveform select circuit 37 selects one of the conductive signals TP1 to TP15 and the GND based on the one-pixel four-bit data from the latch circuit 36.

Therefore, the operation at that time is the same as the case in which one pixel comprises four bits in the fourth embodiment.

Further, when one pixel comprises one bit, each of the conductive signals TP2, TP4, TP4, TP6, TP8, TP10, TP12 and TP14 is set to the same state as the GND such that the conductive waveform select circuit 37 selects the conductive waveform of the GND when four bits data which are input to the conductive waveform select circuit 37 are OH, 2H, 4H, 6H, 8H, AH, CH, and EH. Also, when the four bits data are 1H, 3H, 5H, 7H, 9H, BH, DH and FH, each of the conductive signals TP3, TP5, TP7, TP9, TP11, TP13 and TP15 are set to the same state as the TP1 such that the conductive waveform select circuit 37 selects the conductive waveform of the TP1.

In the operation at that time, even if the upper three bits among the four bits are not masked intentionally, the conductive waveform can be selected using the lower one bit data only irrespective of the values of these three bits. That is, among the four bits, only the lower one bit is effective and the upper three bits are invalid substantially.

Therefore, in such a case, two values can be printed if one bit serial print data is input.

Figure 22:
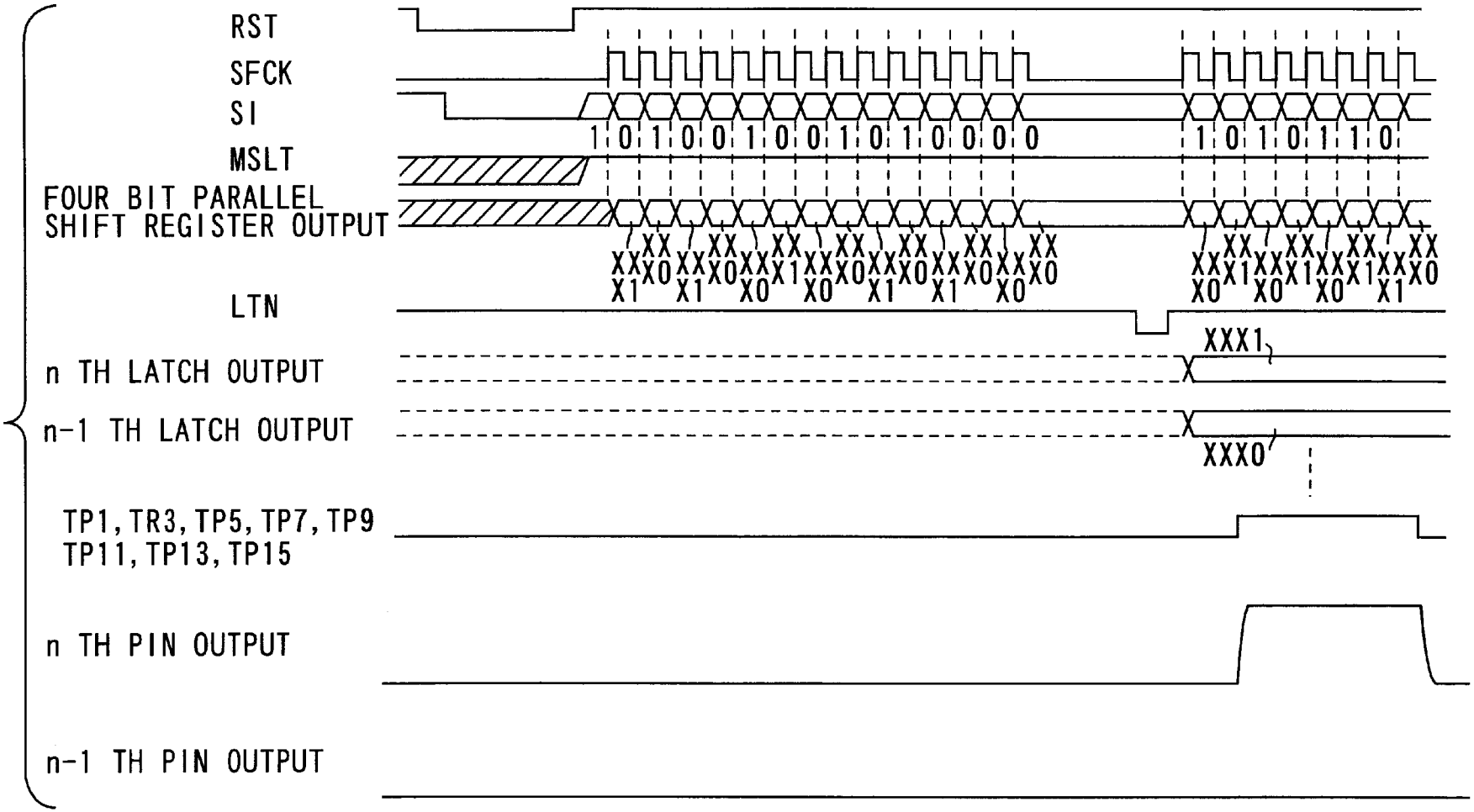
FIG. 22 is a timing waveform diagram showing operation timing when print data in which each pixel comprises one bit is handled in the sixth embodiment.
Figure 23:
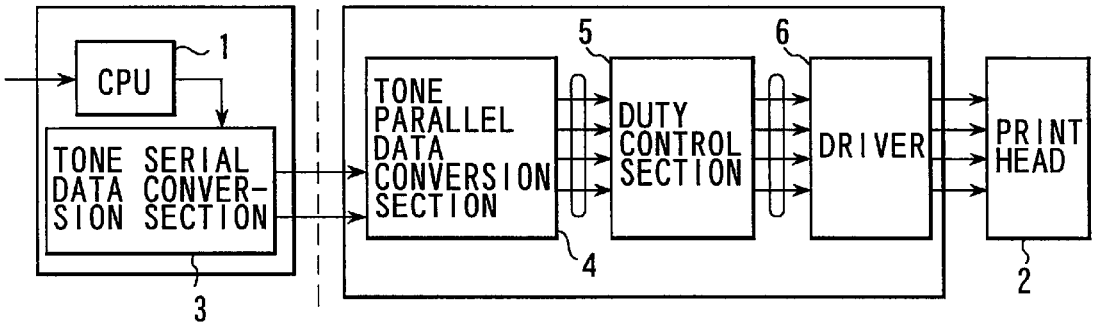
FIG. 23 (PRIOR ART)
FIG. 23 is a circuit block diagram showing a conventional example.
Figure 24:
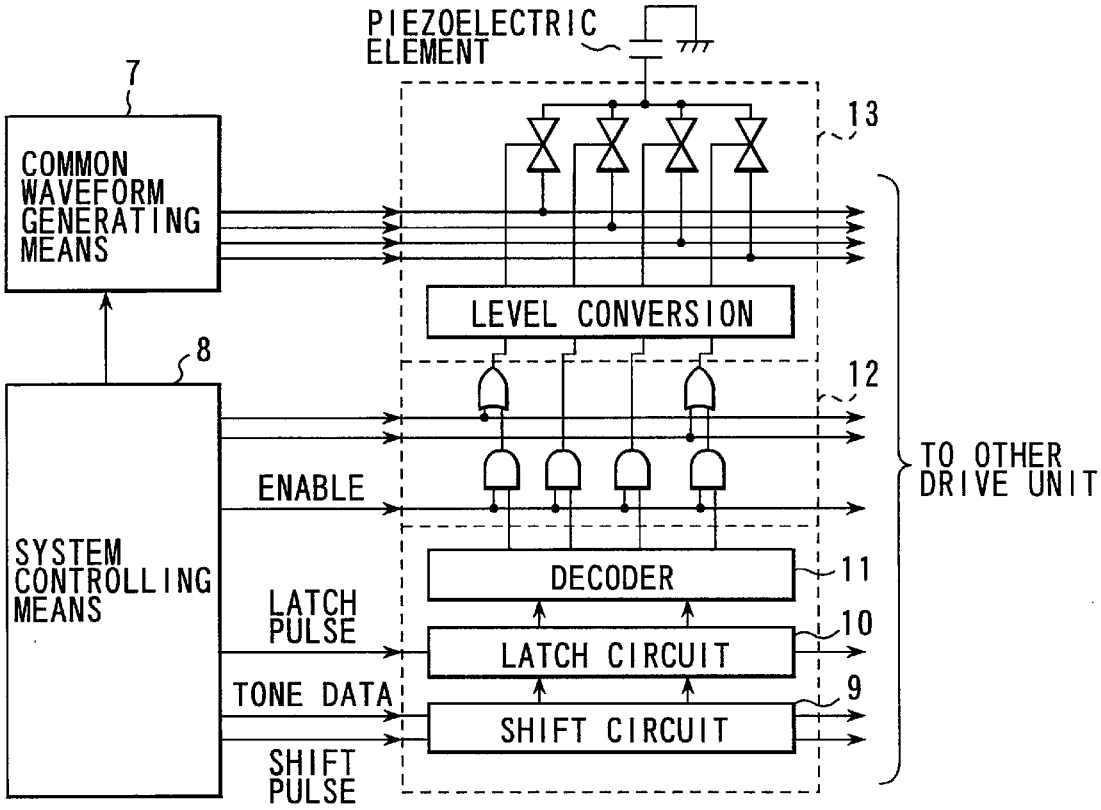
FIG. 24 (PRIOR ART)
FIG. 24 is a circuit block diagram showing another conventional example.
Figure 25:
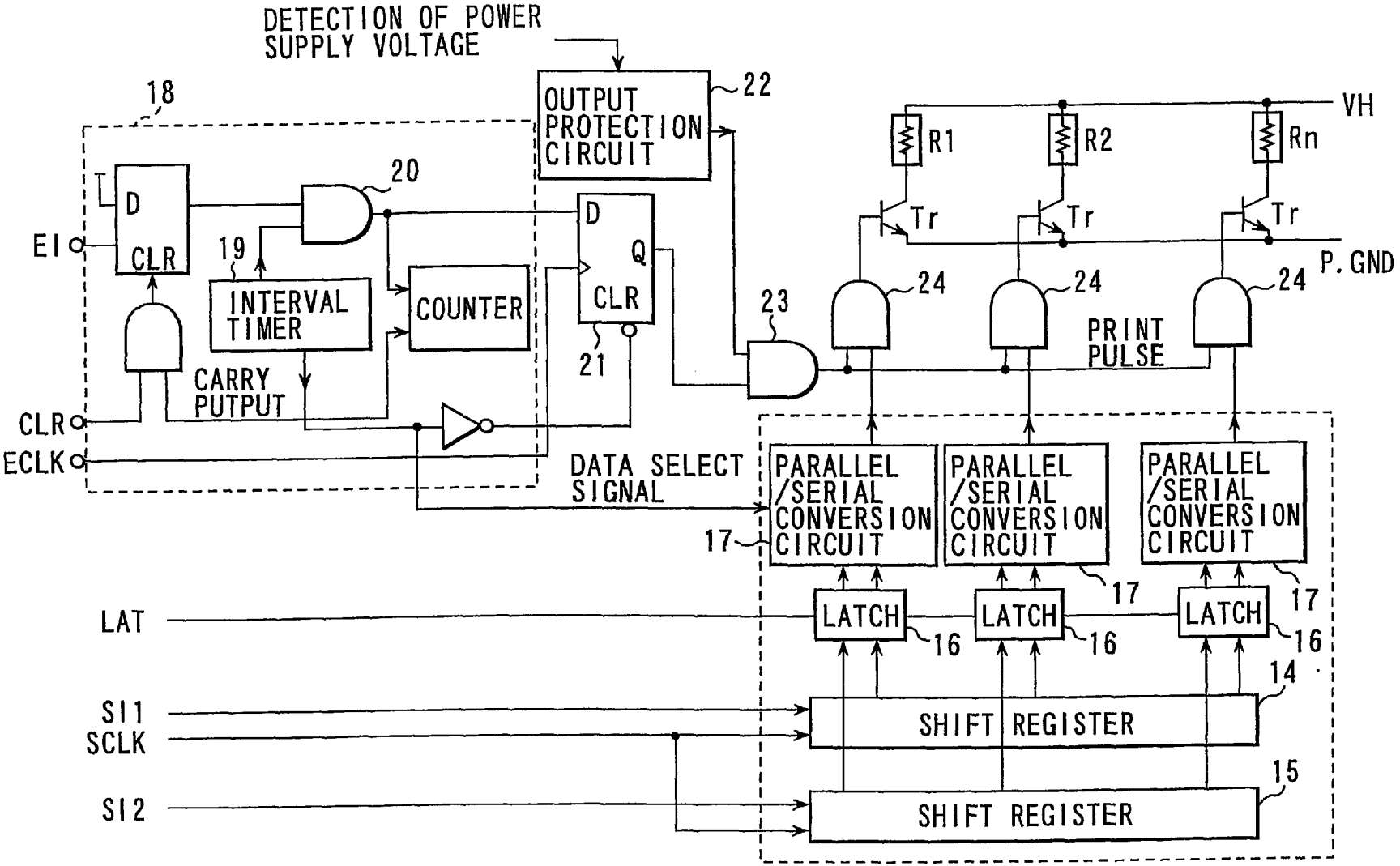
FIG. 25 PRIOR ART
FIG. 25 is a circuit block diagram showing another convention example.

The operation timing when one pixel comprises one bit is as shown in FIG. 22. For example, if the latch output with respect to n th pixel is "xxx1" and the latch output with respect to n−1 th pixel is "xxx0", the conductive waveform select circuit 37 selects any one of the conductive signals TP1, TP3, TP5, TP7, TP9, TP11, TP13 and TP15 with respect to the n th pixel to selects the conductive waveform corresponding to the conductive signal TP1, and selects any one of the conductive signals GND, TP2, TP4, TP6, TP8, TP10, TP12 and TP14 with respect to the n−1 th pixel and selects the conductive waveform corresponding to the conductive signal GND. In this manner, n th pin output waveform for driving n th head element and n−1 th pin output waveform for driving n−1 th head element are generated. The n th pin output waveform is the waveform of the signal TP1, and the n−1 th pin output waveform is a zero output waveform.

Therefore, in this embodiment also, since data can be transferred in series to the printer head driving device, the number of signal lines used for data transfer can be only one. Further, when serial print data at the maximum four bits tone can be received, even if the situation is changed such that one bit serial print data of two values is handed, it is unnecessary to add and transfer dummy data. Therefore, as the print data has smaller bit, the data transfer time can be shortened, and data can be printed faster.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A driving device of a printer head which receives one bit serial print data of maximum n bits tone per one pixel and which determines a driving waveform for driving a printer head in accordance with the received print data, comprising:

serial input shift register means for shifting said received one bit serial print data; and changing means for changing a shift path of said shift register means in accordance with the number m ($1 \leqq m \leqq n$) of bits of tone to be received.

2. A driving device of a printer head according to claim 1, wherein said serial input shift register means comprises a first shift register for inputting one bit serial print data in series to convert it into a parallel output of maximum n bits, and a second register of n bits parallel input connected to said first shift register, said changing means changes said shift path of said shift register means by changing a shift timing of said second shift register.

3. A driving device of a printer head according to claim 2, further comprising:

a serial data output circuit for converting said m bit parallel print data transferred from said n bit parallel shift register of the last step into serial data and outputting the same.

4. A driving device of a printer head according to claim 1, wherein said serial input shift register means comprises a plurality of shift registers connected to one another in series capable of selecting the number m of steps ($1 \leqq m \leqq n$), and said changing means select the number m of steps in accordance with the number m of bits of tone to be received so as to change a shift path of said shift register means.

5. A driving device of a printer head according to claim 3, further comprising:

a serial data output circuit for converting said m bit parallel print data transferred from said n bit parallel shift register of the last step into serial data and outputting the same.

6. A driving device of a printer head according to any one of claim 1, further comprising:

a serial data output circuit for converting said m bit parallel print data transferred from said n bit parallel shift register of the last step into serial data, and outputting the same.

7. A driving device of a printer head which receives one bit serial print data of maximum n bits tone per one pixel and which determines a driving waveform for driving a printer head in accordance with the received print data, comprising:

serial parallel converting means which converts one bit serial print data of m bit ($1 \leqq m \leqq n$) tone into parallel data m bit by m bit and which can converts maximum n bits in parallel;

n bit parallel shift register for transferring m bit parallel print data converted by said serial parallel converting means m bit by m bit;

masking means for masking said n bit parallel data transferred by said n bits parallel shift register other than necessary bit;

selecting means for selecting a conductive waveform of a head in accordance with said m bit parallel print data output from said masking means; and a head driver for supplying the conductive waveform selected by said selecting means to a printer head.

8. A driving device of a printer head according to claim 7, wherein said masking means masks other than a necessary m bit.

9. A driving device of a printer head according to claim 7, further comprising:

a serial data output circuit for converting said m bit parallel print data transferred from said n bit parallel shift register of the last step into serial data and outputting the same.

10. A driving device of a printer head which receives one bit serial print data of maximum n bits tone per one pixel and which determines a driving waveform for driving a head in accordance with the received print data, comprising:

serial parallel converting means which converts one bit serial print data of m bit ($1 \leqq m \leqq n$) tone into parallel data for m bit by m bit;

masking means which takes in mask data for masking m bit parallel print data other than necessary m bit and masks said m bit parallel print data converted by said serial parallel converting means based on said mask data, and to output a timing signal for transferring said masked parallel print data to a rear step;

n bit parallel shift register for taking in said masked parallel print data transferred from said masking means in reply to said timing signal from said masking means, and for transferring said parallel print data m bit by m bit;

selecting means for selecting a conductive waveform of a head in accordance with said parallel print data from said n bit parallel shift register; and a head driver for supplying the conductive waveform selected by said selecting means to a printer head.

11. A driving device of a printer head according to claim 10, wherein said mask data to be taken by said masking means is input from an input terminal of said serial print data.

12. A driving device of a printer head which receives one bit serial print data of maximum n bits tone per one pixel and which determines a driving waveform for driving a head in accordance with the received print data, comprising:

serial parallel converting means which converts one bit serial print data of m bit ($1 \leqq m \leqq n$) tone into parallel data m bit by m bit and which can converts maximum n bits in parallel;

n bit parallel shift register for transferring m bit parallel print data converted by said serial parallel converting means m bit by m bit;

setting means for setting a conductive waveform such that a selection of the conductive waveform by (n−m) bit other than effective m bit of said parallel print data of m bit transferred by said n bit parallel shift register is invalidated;

selecting means for selecting said conductive waveform of a head in accordance with said m bit parallel print data from said n bit parallel shift register; and a head driver for supplying said conductive waveform selected by said selecting means to a printer head.

13. A driving device of a printer head which receives one bit serial print data of maximum n bits tone per one pixel and which determines a driving waveform for driving a head in accordance with the received print data, comprising:

a shift register device having a selector comprising shift registers of the maximum n steps in which when one bit serial print data of m bit ($1 \leqq m \leqq n$) tone is taken, said one bit serial print data is set in the shift registers of m steps;

masking means for masking bits other than effective m bits of utmost n-step bit data output from said shift resister device;

selecting means for selecting said conductive waveform of a head in accordance with said m bit parallel print data output from said masking means; and a head driver for supplying said conductive waveform selected by said selecting means to a printer head.

14. A driving device of a printer head according to claim 13, wherein setting data of the number of steps of said shift registers in said shift register device having the selector is input from an input terminal of said serial print data.

15. A driving device of a printer head according to claim 14, wherein a setting for masking (n−m) bit other than said effective m bit by said masking means is carried out by data input from an input terminal of said serial print data.

16. A driving device of a printer head according to claim 13, wherein a setting for masking (n−m) bit other than said effective m bit by said masking means is carried out by data input from an input terminal of said serial print data.

17. A driving device of a printer head which receives one bit serial print data of maximum n bits tone per one pixel and which determines a driving waveform for driving a head in accordance with the received print data, comprising:

a shift register device having a selector comprising shift registers of the maximum n steps in which when one bit serial print data of m bit ($1 \leqq m \leqq n$) tone is taken, said one bit serial print data is set in the shift registers of m steps;

setting means which treats data output from each of the steps set by said shift register device as m bit parallel print data, and which sets a conductive waveform such that a selection of the conductive waveform by a bit other than effective m bit of said parallel print data of m bit is invalidated;

selecting means for selecting said conductive waveform of a head in accordance with said m bit parallel print data output from said shift register device having a selector; and a head driver for supplying said conductive waveform selected by said selecting means to a printer head.

* * * * *